United States Patent [19]

Barber

[11] 4,028,901

[45] June 14, 1977

[54] METHOD AND APPARATUS FOR ASSEMBLING SHEET PILING

[76] Inventor: Stanley Barber, 3310 S. 27th St., Fort Smith, Ark. 72901

[22] Filed: Nov. 19, 1975

[21] Appl. No.: 633,466

Related U.S. Application Data

[63] Continuation-in-part of Ser. No. 532,218, Dec. 12, 1974, abandoned.

[52] U.S. Cl. ..... 61/63; 61/53.5; 61/60

[51] Int. Cl.[2] ..... E02D 13/04

[58] Field of Search ..... 61/63, 53.5, 58, 60, 61/61

[56] References Cited

UNITED STATES PATENTS

| | | | |
|---|---|---|---|
| 2,275,662 | 3/1942 | Sturdy | 61/63 |
| 2,583,928 | 1/1952 | Caudill | 61/63 |
| 2,968,931 | 3/1959 | McGrath | 61/63 |
| 3,019,608 | 2/1962 | Marmion | 61/63 |

*Primary Examiner*—Jacob Shapiro
*Attorney, Agent, or Firm*—Lowe, Kokjer, Kircher, Wharton & Bowman

[57] ABSTRACT

A method and apparatus for aligning the longitudinal margin of a loose sheet piling section above the mating margin of a set piling section to permit the piling sections to interlock. A base which supports a movable jaw mechanism is positioned on top of the set piling section. The jaw mechanism receives the loose piling section and includes rollers which guide the loose section as it is raised. When the loose section clears the top of the set section, a camming roller forces it laterally to align its margin above the mating margin of the set piling section. A further embodiment includes gripping elements on the base and interchangeable templates on the jaw mechanism which accommodate piling sections of various configurations. The templates carry universally rotatable rollers which guide the loose section and shift it laterally by camming action when it clears the top of the set piling section. A third embodiment provides a pair of jaws, one on each half of the device, so that piling sections can be interlocked with either edge of the set section. Each jaw opens and closes about a horizontal hinge axis to resist any tendency of the jaw to twist open if the loose piling section is out of plumb. Masts extend above the platform and alignment legs extend below the platform to assure accurate alignment of the piling sections.

19 Claims, 25 Drawing Figures

Fig. 20.
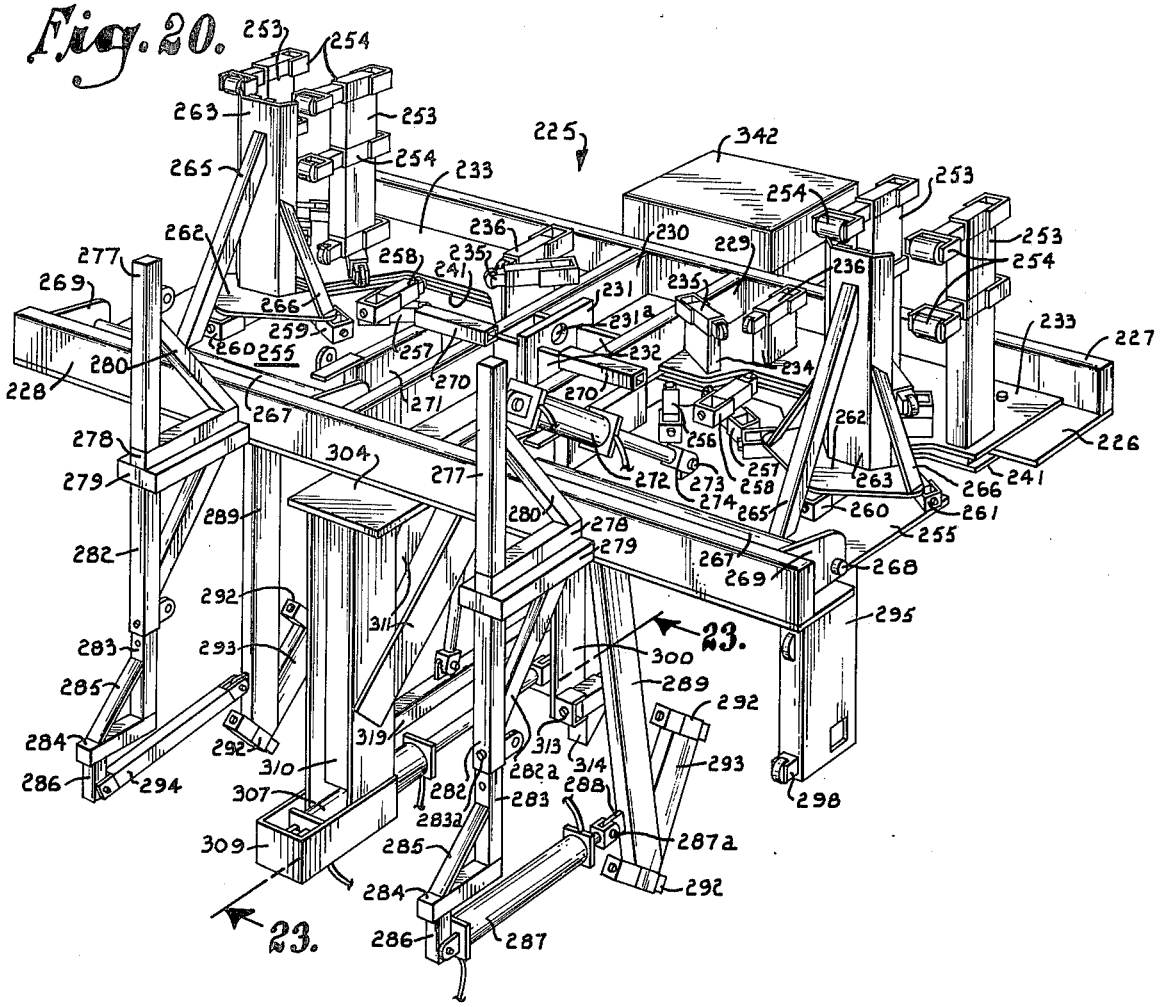
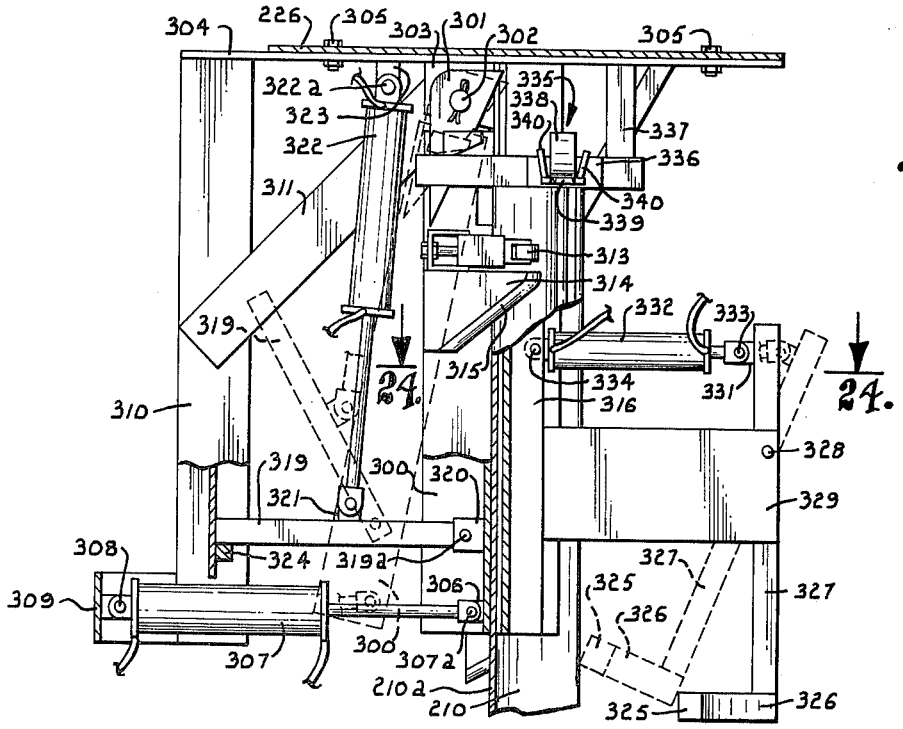
Fig. 23.

METHOD AND APPARATUS FOR ASSEMBLING SHEET PILING

BACKGROUND AND SUMMARY OF THE INVENTION

This is a continuation-in-part application of my copending application Ser. No. 532,218, filed Dec. 12, 1974 now abandoned.

This invention relates generally to the assembly of sheet piling and more particularly to a method and apparatus for interlocking the mating edges of sheet piling sections.

Cofferdams and similar structures are constructed by assembling a series of sheet piling sections with their edges interlocked to form a continuous upright wall. The long, narrow piling sections are of various configurations and are provided with mating edges that interlock with adjacent sections in a telescopic manner. In assembling the piling, each section must be raised by a crane above a previously set section and positioned properly so that the mating edges of the two sections will interlock as the raised section is lowered.

A common practice in the industry is to station a man referred to as a "stabber" on top of the erect piling in order to thread the edges of the piling sections. The stabber manually grasps each raised piling section and aligns its edge with the mating edge of the previously set section before signaling the crane operator to lower and raised section. The stabber works on top of set piling that is typically of a height of 100 feet or more, and he must handle extremely heavy piling sections that are elevated to over twice that height and suspended at their top ends by a crane. It is therefore not surprising that the stabbers are often subject to serious injury. The lack of stability and resulting tendency of the raised piling section to swing creates such danger to the stabbers that construction must be halted on windy days, which are not uncommon in the vicinity of lakes and rivers. Even in good weather, the extreme caution with which the stabbers must work causes the construction time to be extended and increases the cost accordingly.

Mechanical devices that have been developed in the past to align the piling sections are typically clamped to the bottom of the loose section and attached to the edge of the set section in a manner to slide or roll up the set section. These devices are overly complex and costly because they require a strong clamp member for firm attachment to the loose section, a complicated slide of roller mechanism that rides up the set section, and still another mechanism that acts to move the loose section laterally after it has cleared the top end of the set section. Furthermore, for each piling section that is to be raised, the device must be disconnected from two piling sections, moved by the workmen, and reconnected to two other piling sections. Each step in this cumbersome procedure requires considerable time and effort which delays the construction and leads to excessive costs. Existing devices also lack versatility in that they are constructed for use in handling sheet piling of only one particular configuration. Since the piling sections come in a variety of shapes, a separate device is required for the assembly of each different type of piling.

The manner in which existing devices attach to the piling sections and guide the loose section leads to further difficulties in maintaining the loose section in a proper position as it is raised. The device rides upwardly along the set section to a height of 100 feet or more each time a loose section is raised. Since the device itself is in motion along with the loose section, it is likely to become disoriented or to completely release from either or both of the piling sections. This is a particularly serious problem because the piling sections become worn and often present ragged edges which the device is unable to ride up in the proper manner. Also, these devices do not guide the loose section along its entire length but are instead attached only to the bottom of the loose section. It is therefore difficult to maintain the loose section in a vertical orientation with its edge against the set section, particularly on windy days and under other poor weather conditions.

In view of the foregoing difficiencies in the prior art, there remains a need for an improved method and apparatus to reduce the danger, difficulty and time involved in assembling sheet piling sections. It is the primary goal of the present invention to meet that need.

More specifically, it is an object of the invention to provide a method and apparatus for quickly, safely and accurately aligning the margin of a loose piling section with the mating margin of a set piling section.

Another object of the invention is to provide a method and apparatus of the character described that operates effectively on windy days and under other poor weather conditions.

Yet another object of the invention is to provide a method of the character described wherein the loose piling section is firmly maintained against the set piling section and in an accurate vertical orientation as it is raised. To accomplish this, the loose piling section is continuously engaged along substantially its entire length at a location above the top end of the set piling section, in contrast to prior art methods which hold only the moving bottom end of the loose section against the set section.

A further object of the invention is to provide a method of the character described in which the loose piling section is rotatably engaged to guide it accurately while minimizing the frictional forces.

An additional object of the invention is to provide an apparatus of the character described that automatically shifts the loose piling section laterally into an aligned position when it clears the top end of the set piling section.

Still another object of the invention is to provide an apparatus of the character described which is supported in a stable position on top of the set piling as it operates to guide the loose piling section.

As a corollary to the preceding object, it is a further object of the invention to provide an apparatus that includes gripping elements which tightly grip the set piling section on which it is supported.

Yet another object of the invention is to provide an apparatus of the character described in which a single mechanism acts to guide the loose piling section as well as to shift it laterally into an aligned position above the set piling section.

A still further object of the invention is to provide an apparatus of the character described that is readily adapted for use with piling sections of various configurations.

An additional object of the invention is to provide an apparatus of the character described that operates to successively assemble two loose piling sections without the necessity of being repositioned.

Another object of the invention is to provide an apparatus of the character described which is able to accurately align the mating margins of piling sections in situations where the top ends of the sections are staggered.

Still another object of the invention is to provide, in an apparatus of the character described, a jaw for closing on the loose piling section which is hinged to open and close about a horizontal axis in order to eliminate any tendency of the jaw to be inadvertently twisted open when the loose section is out of plumb.

An additional object of the invention is to provide an apparatus of the character described which is constructed with a pair of guide jaws to permit loose sections to be interlocked with either margin of the set section.

Other and further objects of the invention, together with the features of novelty appurtenant thereto, will appear in the course of the following description.

DETAILED DESCRIPTION OF THE INVENTION

In the accompanying drawings which form a part of the specification and are to be read in conjunction therewith, and in which like reference numerals are used to indicate like parts in the various views.

Figure 8:
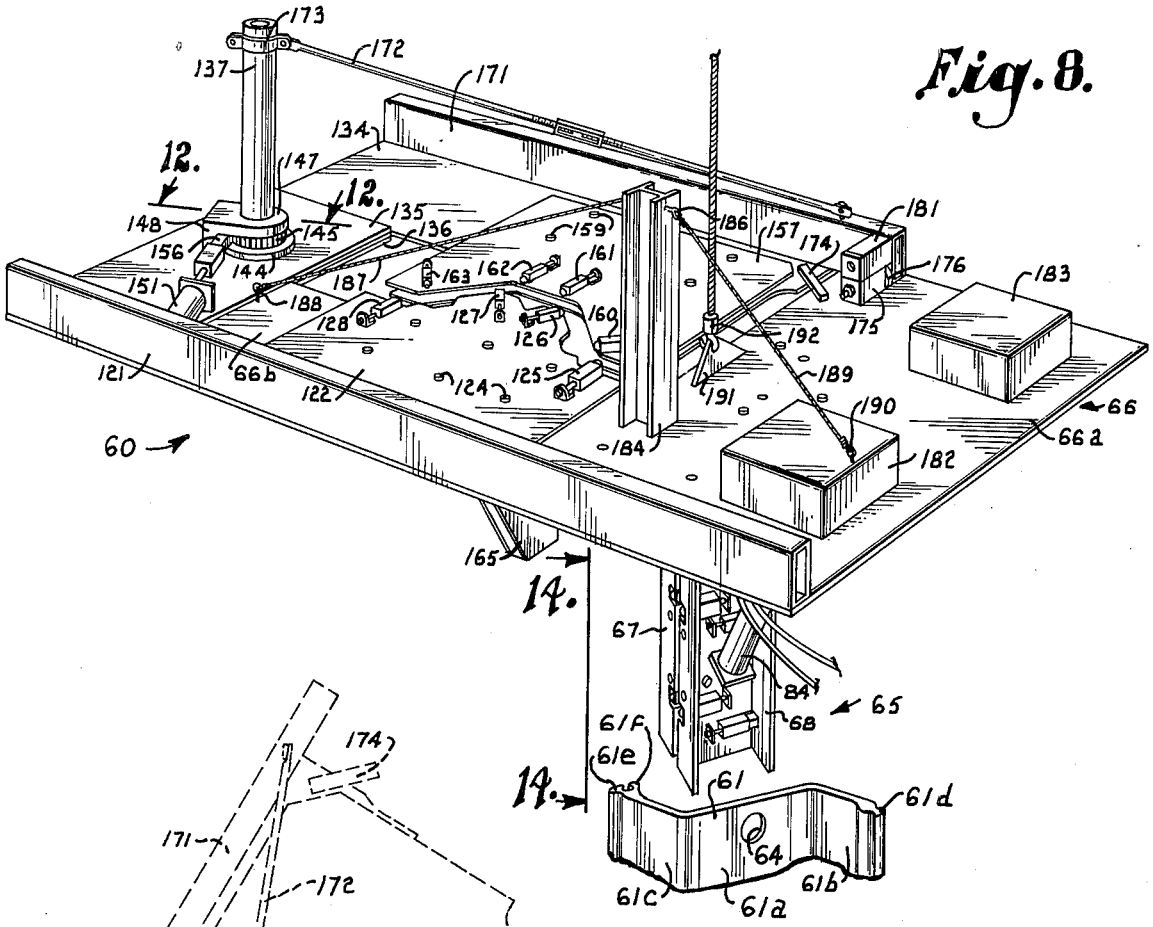
FIG. 8 is a perspective view of a sheet piling alignment device constructed in accordance with a second embodiment of the invention and showing the alignment device elevated above a generally Z-shaped piling section.
Figure 9:
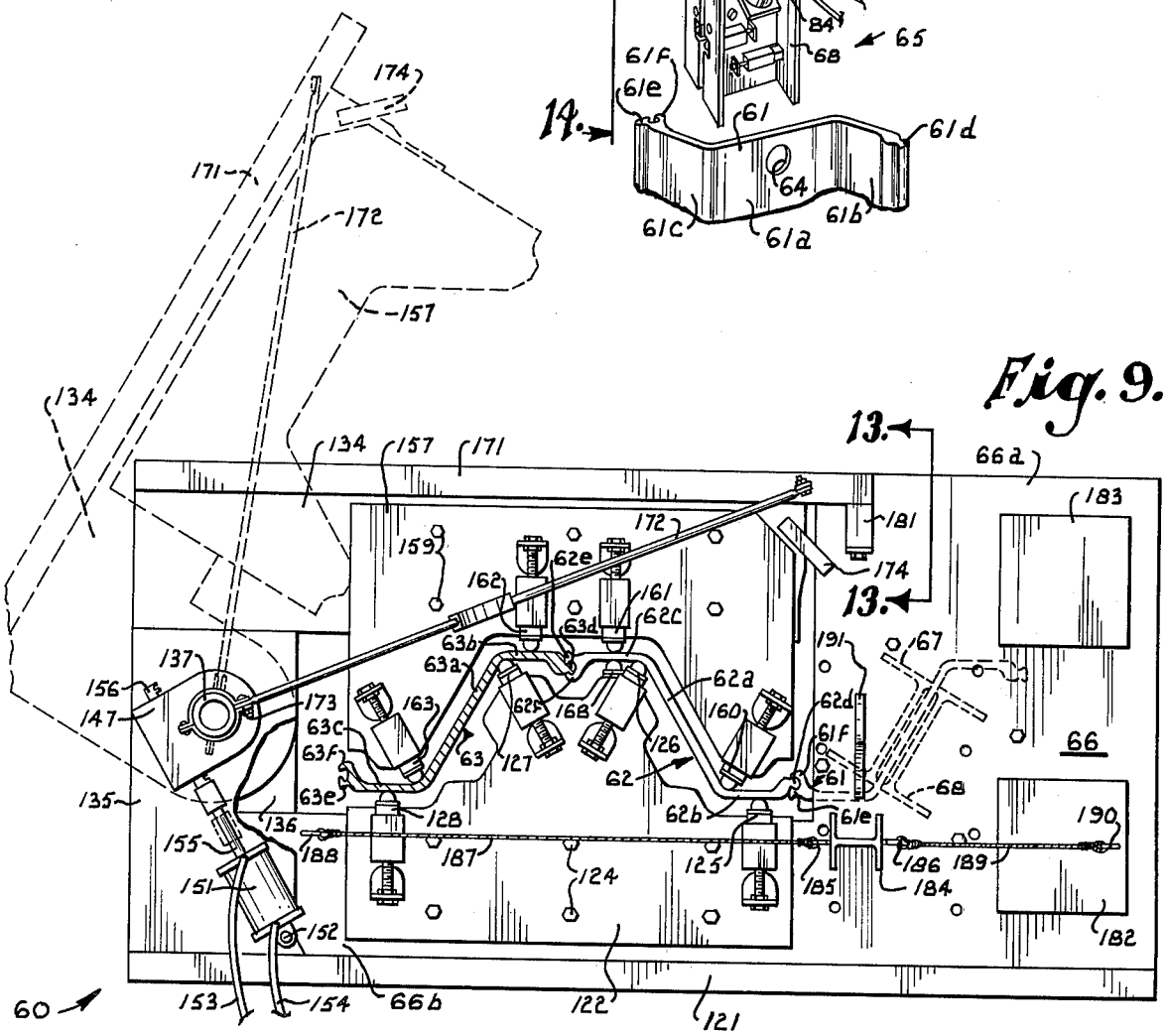
Figure 10:
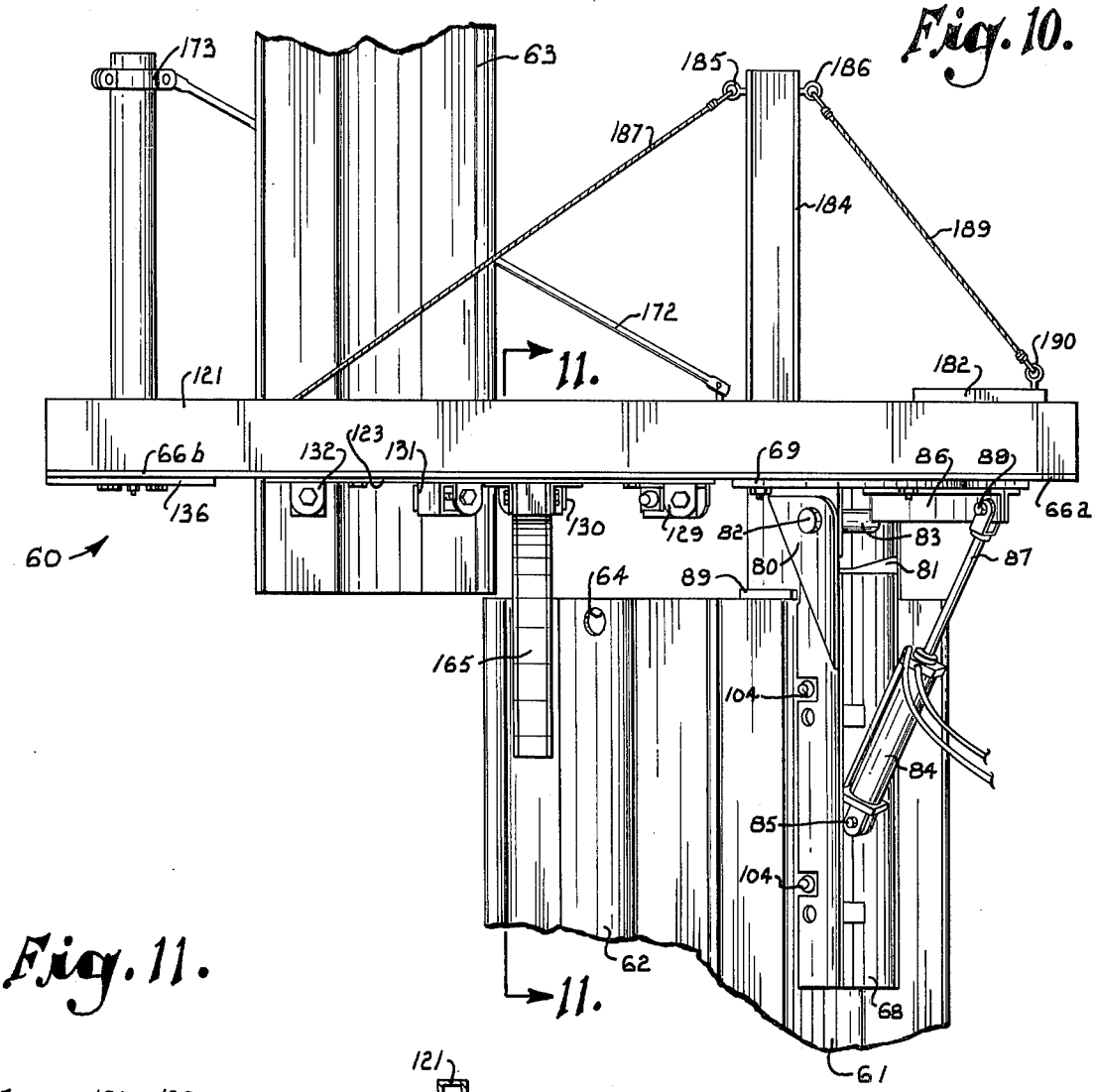
Figure 11:
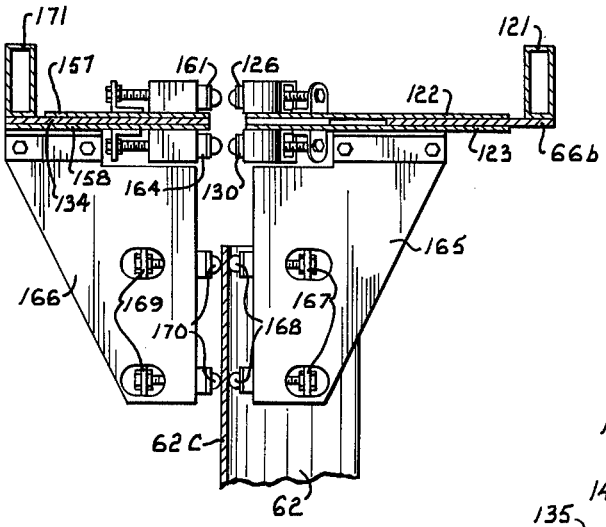
Figure 12:
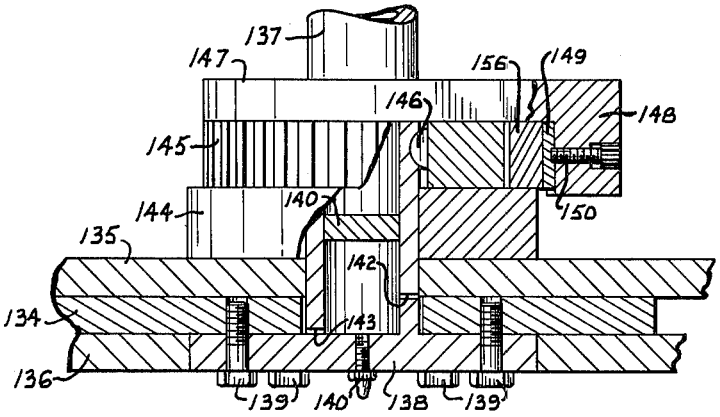
Figure 13:
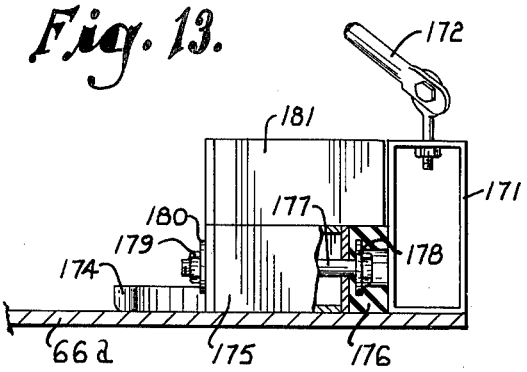
Figure 15:
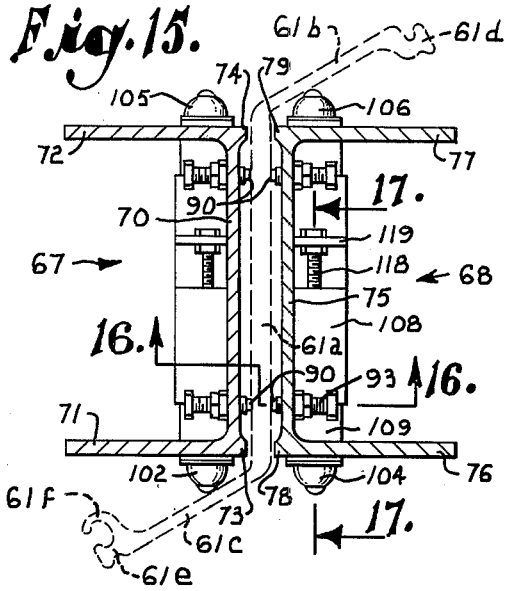
Figure 14:
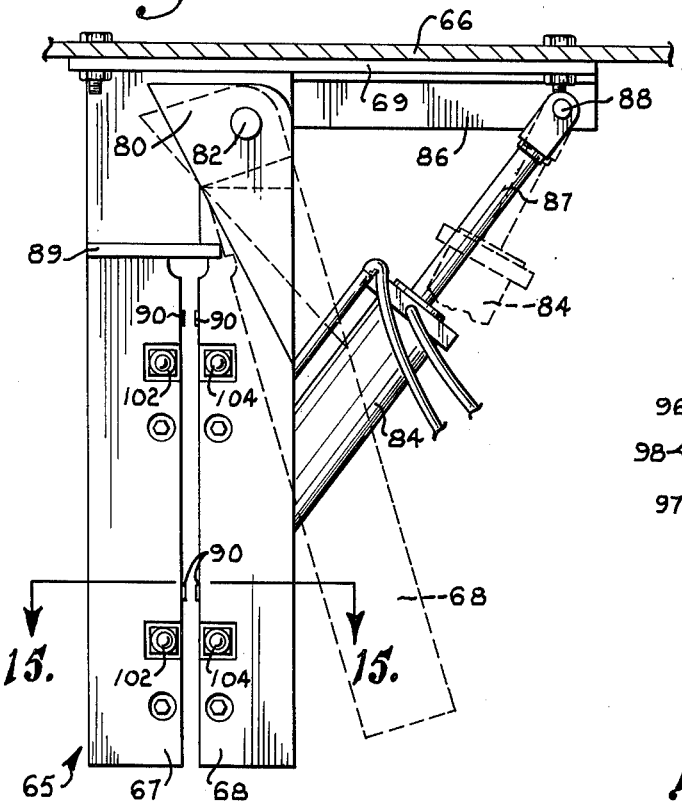
Figure 16:
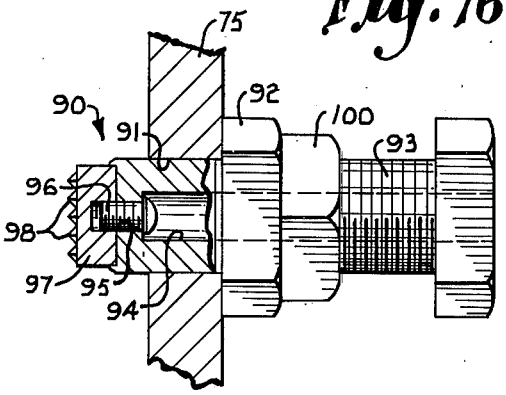
Figure 17:
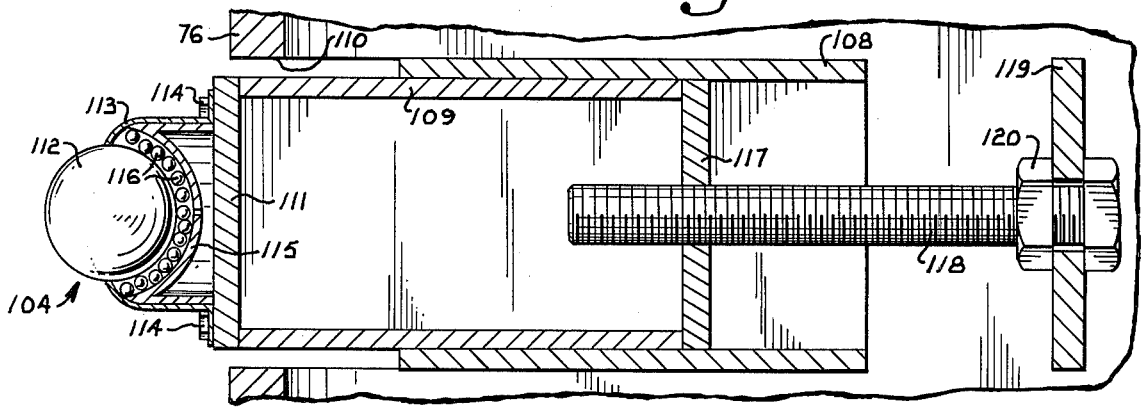
Figure 18:
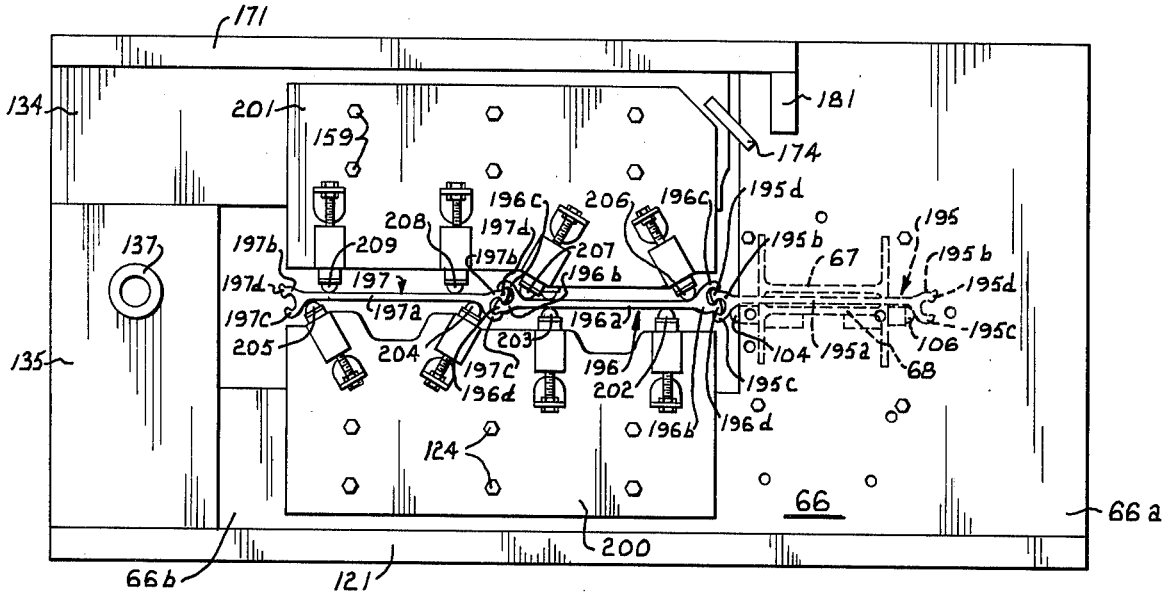
Figure 19:
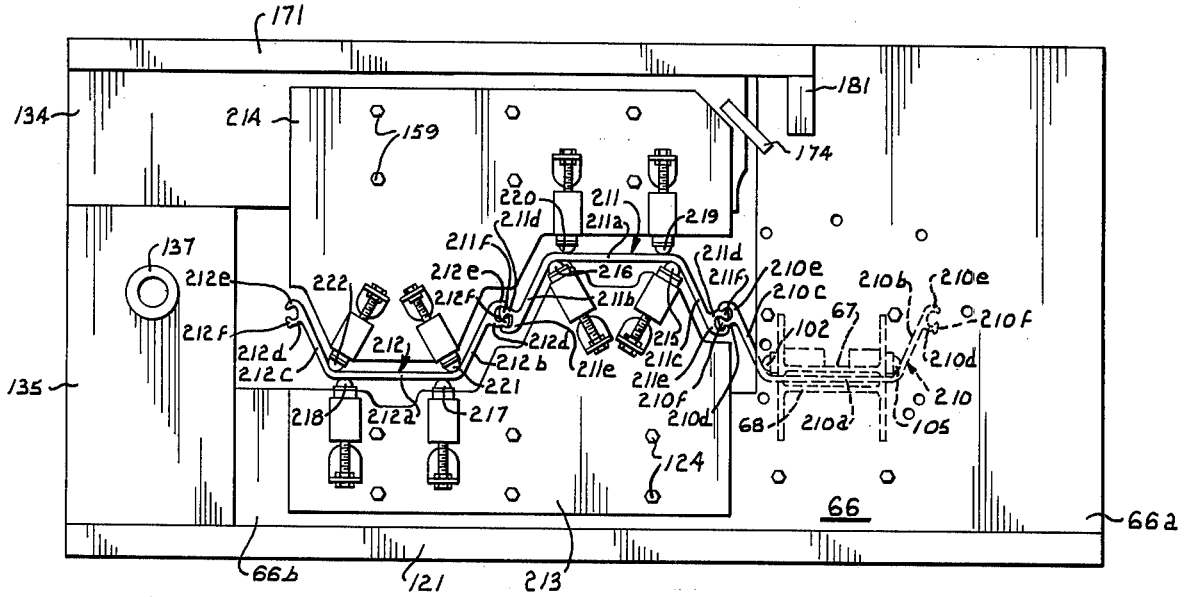
Figure 21:
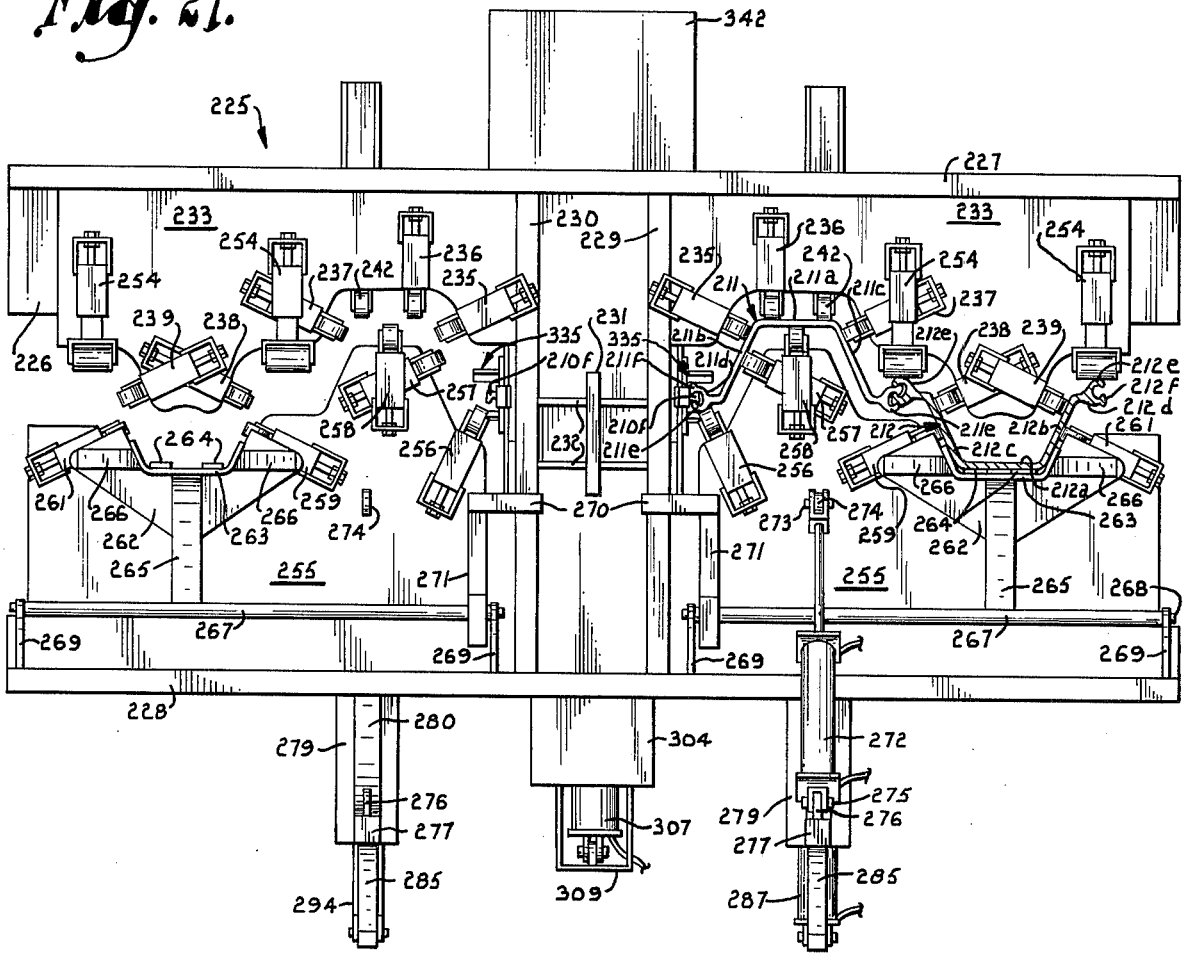
Figure 24:
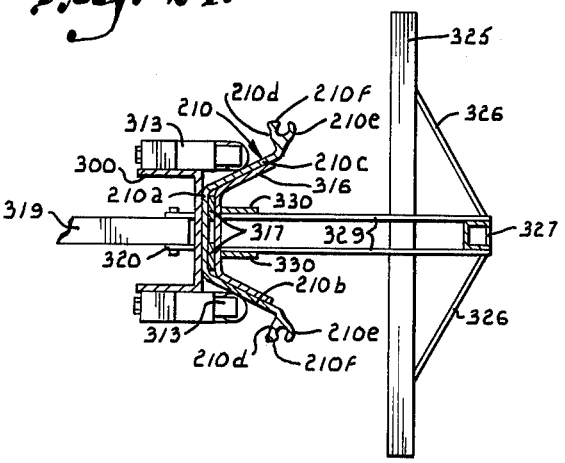
Figure 25:
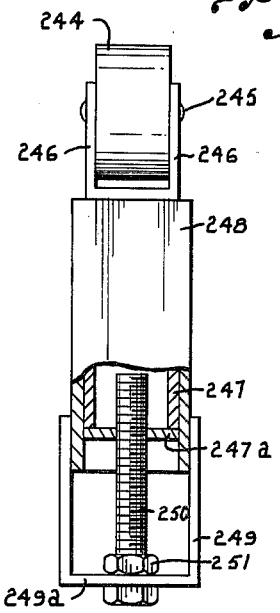
Figure 22:
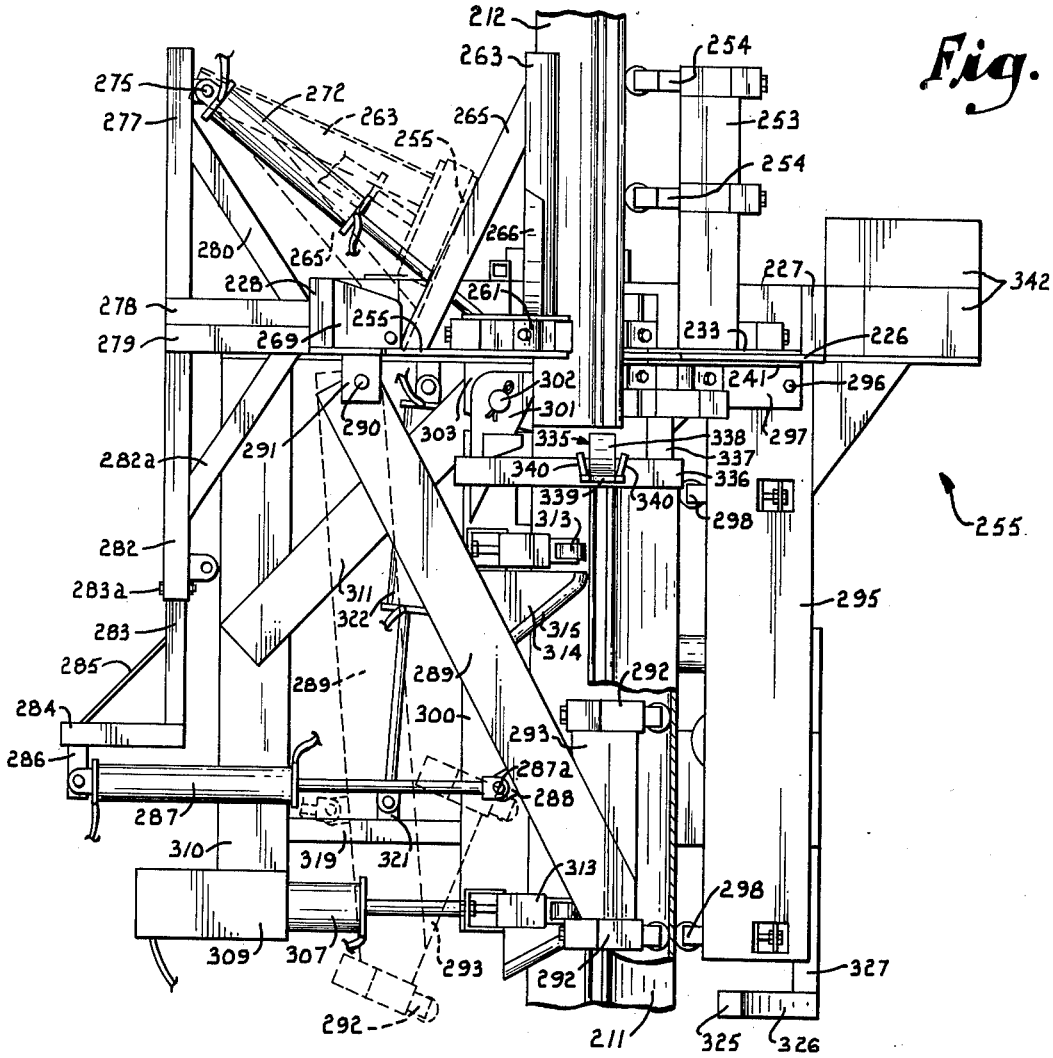

FIG. 9 is a top plan view of the sheet piling alignment device shown in FIG. 8 positioned on top of a set Z-shaped piling section, with a second Z-shaped piling section interlocked with the first section and a loose Z-shaped piling section raised above the second section and positioned with its edge in alignment above the mating edge of the second section, the broken line view of the jaw mechanism illustrating the open position;

FIG. 10 is an elevational view of the sheet piling alignment device in the position shown in FIG. 9, with the three Z-shpaed piling sections being fragmentarily shown;

FIG. 11 is an elevational, cross-sectional view taken generally along line 11—11 of FIG. 10 in the direction of the arrows;

FIG. 12 is an enlarged elevational view, partially in cross section, taken generally along line 12—12 of FIG. 8 in the direction of the arrows;

FIG. 13 is an enlarged elevational view, partially in cross section, taken generally along line 13—13 of FIG. 9 in the direction of the arrows;

FIG. 14 is an enlarged, elevational view taken generally along line 14—14 of FIG. 8 in the direction of the arrows, with the broken line view illustrating the movable leg of the base in an open position;

FIG. 15 is an enlarged, cross-sectional view taken generally along line 15—15 of FIG. 14 in the direction of the arrows, with the broken lines illustrating a set Z-shaped piling section received between the legs of the base;

FIG. 16 is an enlarged, cross-sectional view taken generally along line 16—16 of FIG. 15 in the direction of the arrows;

FIG. 17 is an enlarged, cross-sectional view taken generally along line 17—17 of FIG. 15 in the direction of the arrows;

FIG. 18 is a top plan view illustrating the second embodiment of the sheet piling alignment device with a first alternative set of templates having been interchanged for the templates shown in FIGS. 8 and 9 in order to assemble flat piling sections, with various components excluded for clarity and simplicity and the broken lines showing the position of the base on top of the first set piling section;

FIG. 19 is a top plan view illustrating the second embodiment of the sheet piling alignment device with a second alternative set of templates having been interchanged in order to assemble arch-web piling sections, with various components excluded for clarity and simplicity and the broken lines showing the position of the base on top of the first set piling section;

FIG. 20 is a perspective view of a sheet piling alignment device constructed in accordance with a third embodiment of the invention, with the two jaws and the support leg thereof in their closed positions;

FIG. 21 is a top plan view of the device shown in FIG. 20 positioned on top of a set arch-web piling section, with a second arch-web piling section interlocked with the set section and a third arch-web section interlocked with the second section;

FIG. 22 is an end elevational view of the device in the position shown in FIG. 21, with the broken lines indicating the jaw and the alignment leg pivoted to open positions;

FIG. 23 is an elevational view, partially in cross section, taken generally along line 23—23 of FIG. 20 in the direction of the arrows;

FIG. 24 is a fragmentary cross-sectional view taken generally along lie 24—24 of FIG. 23 in the direction of the arrows; and FIG. 25 is an enlarged plan view illustrating in detail the construction and adjustable mounting of one of the roller assemblies included in the third embodiment of the invention, with a portion broken away to illustrate the details of construction.

Figure 1:
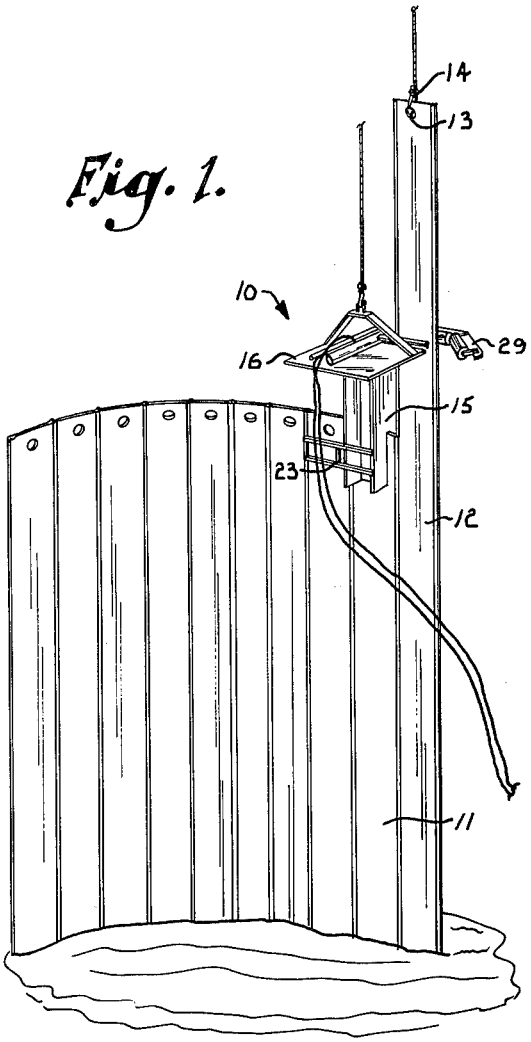
FIG. 1 is a perspective view illustrating a sheet piling alignment device constructed in accordance with a first embodiment of the invention operating on top of a partially completed cofferdam made up of interlocked sheet piling sections, with a loose piling section being lowered to interlock with the last set piling section of the cofferdam.

Referring now to the drawings in detail and initially to FIGS. 1–7, a sheet piling alignment device constructed in accordance with a first embodiment of the invention is generally designated by reference numeral 10. In FIG. 1 alignment device 10 is illustrated in operating position on top of a partially completed cofferdam which is constructed from a plurality of sheet piling sections interlocked at their edges and set uprightly in a lake bed. The last set piling section is designated by reference numeral 11, while numeral 12 indicates a loose piling section that is to be interlocked with section 11.

Figure 3:
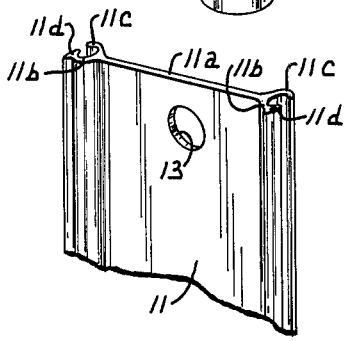
FIG. 3 is a fragmentary, perspective view of the top portion of a flat sheet piling section having a straight web and double flanges on its longitudinal edges.

Referring now to FIG. 3, the configuration of piling section 11 is shown in detail. A straight flat web 11*a* is provided with a pair of curved flanges 11*b* and 11*c* at each longitudinal edge. Each pair of flanges 11*b* and 11*c* together define a substantially C-shaped double flange which presents a longitudinal groove a keyway. Each flange 11*b* has an enlarged lip or key lid on its terminal edge which is sized to fir closely within the keyway of another piling section. Piling section 12 is constructed identically, comprising a flat central web 12*a*, respective pairs of flanges 12*b* and 12*c* at the edges of web 12*a* which form a keyway therebetween, and an enlarged lip 12*d* formed on the edge of each flange 12*b*. A circular opening 13 is formed through the web of each piling section near the top end thereof to receive hoisting tackle 14 (FIG.1) that is carried by a crane (not shown).

Figure 2:
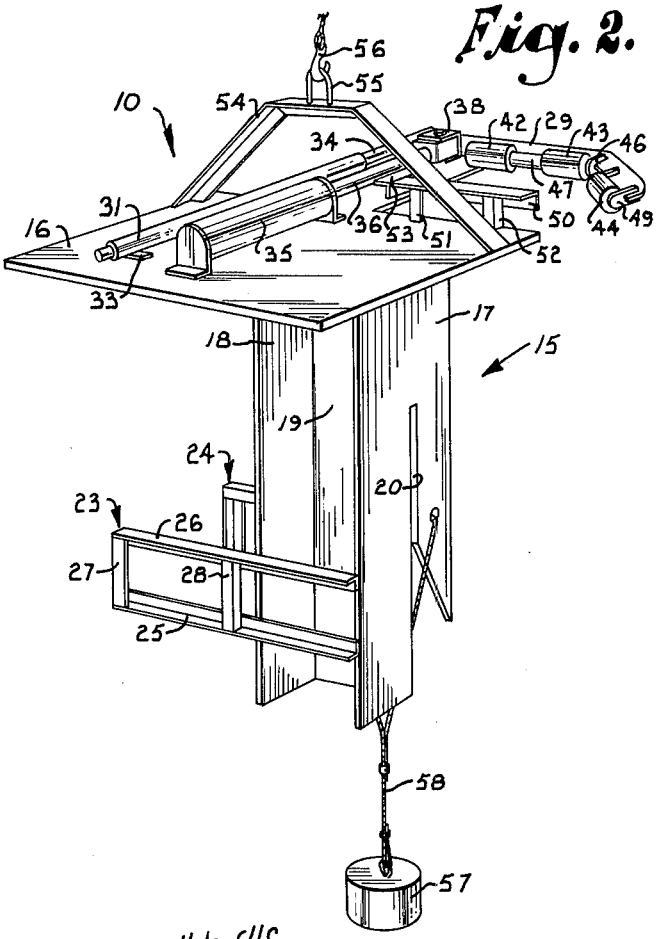
FIG. 2 is an enlarged, perspective view of the sheet piling alignment device shown in FIG. 1 with the jaw thereof in an open position.

Alignment device 10 includes a vertical base 15 which is secured to a horizontal platform 16 at its top end. Referring to FIG. 2 in particular, base 15 comprises a vertical H-beam which includes opposite side walls 17 and 18 centrally connected by a flat web 19. Each side wall 17 and 18 has a vertical slot 20 formed therethrough (only one of which is seen in FIG. 2). The respective slots 20 are located adjacent to web 19 and extend upwardly through a majority of side walls 17 and 18 but terminate a substantial distance below the top end of base 15. The width of each slot 20 is slightly greater than the thickness of the web of a piling section so that the slots will fit closely over the piling section. On one side of each slot 20, side walls 17 and 18 are cut outwardly and downwardly at an angle to form a notch having the general shape of an inverted V. A pair of vertical ear plates 21 and 22 (FIG. 7) extend outwardly from side wall 18 adjacent the opposite edges of slot 20. Plates 21 and 22 assist in maintaining base 15 in a stable position on top of the set piling section.

With continued reference to FIG. 2, a pair of fence-like guides 23 and 24 are secured above the bottom ends of side walls 17 and 18. Guide 23 is welded to one edge of each side wall 17 and 18 while guide 24 is welded to the opposite edges of side walls 17 and 18. Each guide 23 and 24 comprises a pair of horizontal angles 25 and 26 which are interconnected by respective vertical struts 27 and 28 at their outward ends and centers. Guides 23 and 24 are parallel to one another and project a considerable distance beyond side wall 18.

Figure 4:
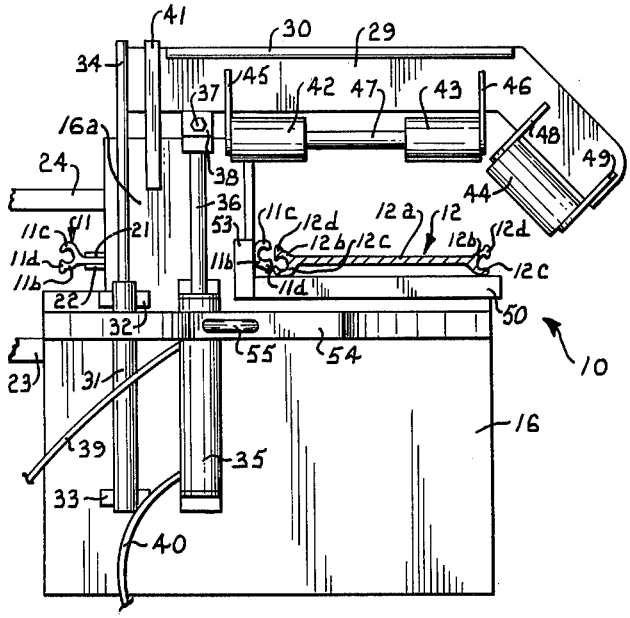
FIG. 4 is a top plan view of the sheet piling alignment device positioned on top of a set piling section and showing a loose piling section inserted within the open jaw prior to the jaw closing thereon.
Figure 5:
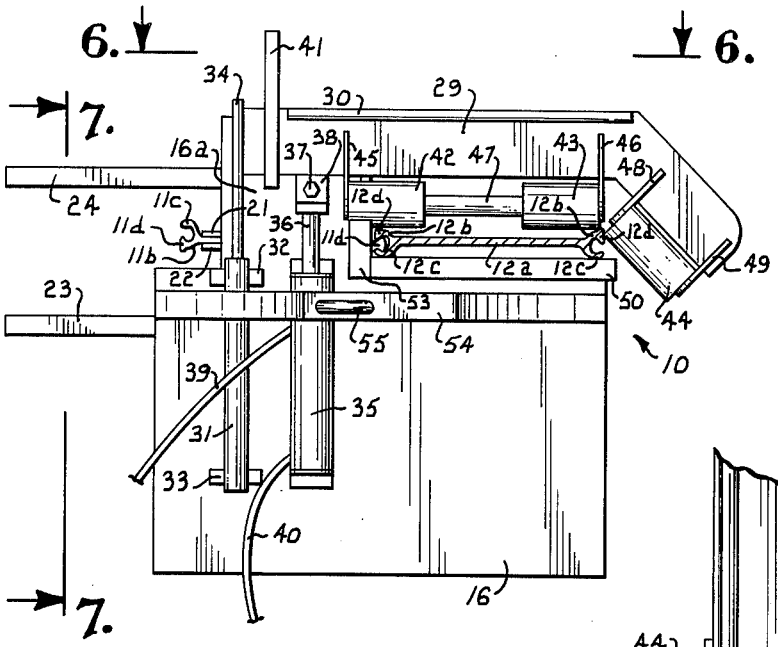
FIG. 5 is a top plan view similar to FIG. 4, but showing the jaw closed on a loose piling section which has been raised above the set piling section and positioned with its edge in alignment above the mating edge of the set piling section.
Figure 6:
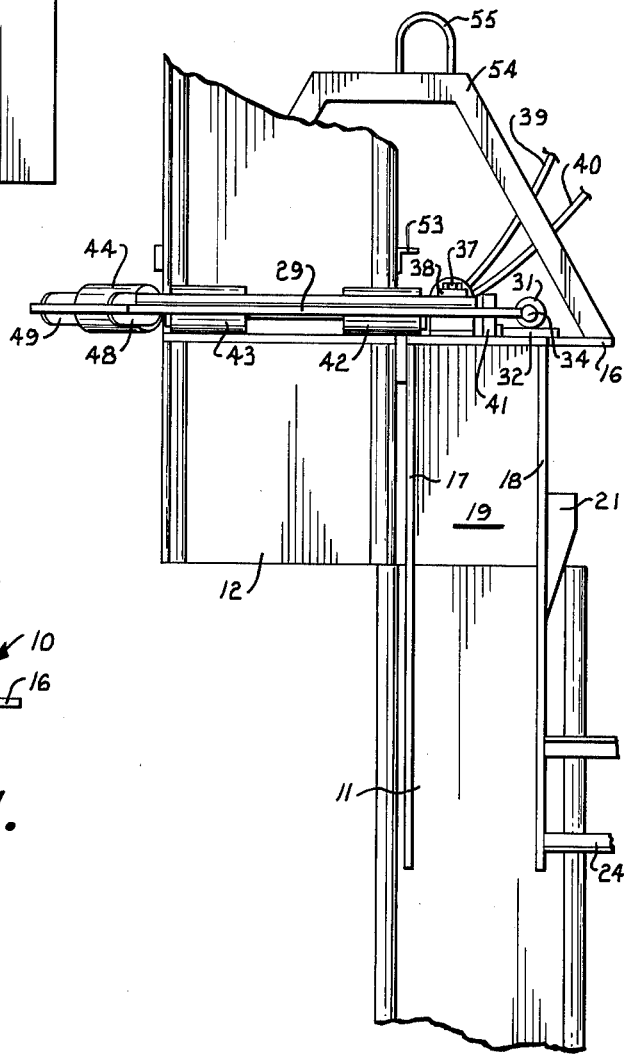
FIG. 6 is an elevational view taken generally along line 6—6 of FIG. 5 in the direction of the arrows, with the piling sections beig fragmentarily shown.

Referring particularly to FIGS. 4 and 5, platform 16 is basically rectangular throughout its major portion and includes an overhanging section 16*a* which extends outwardly from one edge of the rectangular portion of the platform. Base 15 is secured to the underside of the platform at a position such that slots 20 are located below the overhanging section 16*a*. Platform 16 supports a movable jaw mechanism which receives and closes upon a loose piling section inserted therein. The jaw mechanism includes a movable arm 29 which comprises a horizontal plate having a straight portion and an outer end portion that angles inwardly at approximately 45°. An elongate bar 30 is secured to the straight portion or arm 29 to increase the rigidity of the arm.

Figure 7:
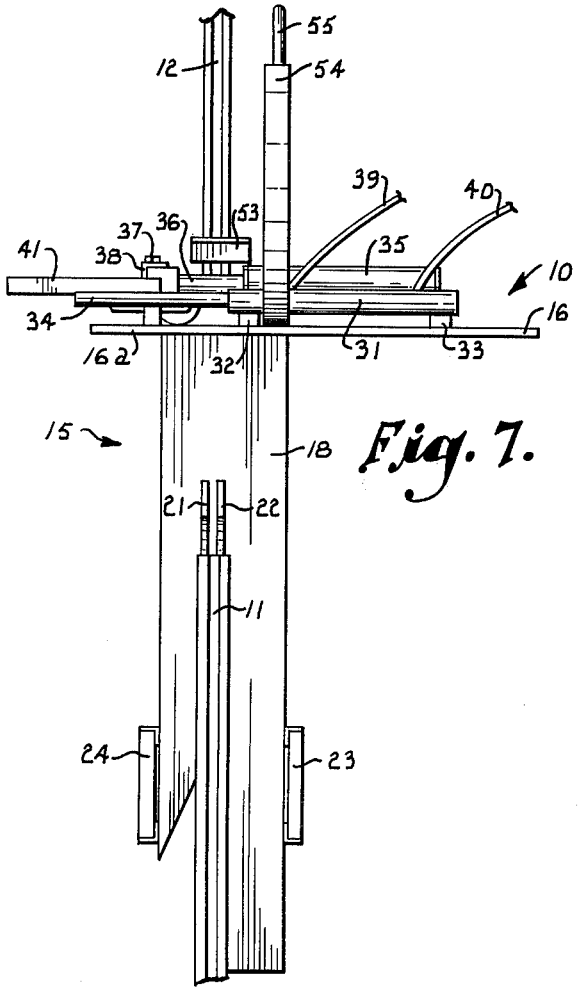
FIG. 7 is an elevational view taken generally along 7—7 of FIG. 5 in the direction of the arrows, with the piling sections being fragmentarily shown.

Arm 29 is supported for movement toward and away from platform 16. A cylindrical sleeve 31 is mounted on top of a pair of spaced mounting pads 32 and 33 which are secured to the top of the platform. Pad 32 is located near platform section 16*a*, while pad 33 is located on the main rectangular portion of the platform. Sleeve 31 slidably receives an elongate cylindrical rod 34 which is welded at its outer end to the end or arm 29. A conventional cylinder (hydraulic or pneumatic) 35 is mounted on top of platform 16 at a location beside sleeve 31 with its piston rod 36 parallel to rod 34. The outer end of piston rod 36 is pinned at 37 to a U-shaped bracket 38 which is secured to arm 29. A pair of fluid lines 29 and 40 connect to cylinder 35 in the usual manner, while conventional controls (not shown) for extending and retracting piston rod 36 are located at ground level. As best shown in FIG. 7, an L-shaped stop member 41 comprises a short vertical leg which is secured to platform section 16*a* and a longer horizontal leg that projects outwardly beyond section 16*a* from the top of the vertical leg. Arm 29 slides inwardly and outwardly against the underside of the horizontal leg of member 41, while engagement with the vertical leg of member 41 limits the inward movement of arm 29.

A pair of cylindrical guide rollers 42 and 43 and a cylindrical camming roller 44 are supported on arm 29. Brackets 45 and 46 are secured to the straight portion of arm 29. A horizontal shaft 47 is supported between brackets 45 and 46 at the same elevation as arm 29. Guide roller 42 is mounted for free rotation on shaft 47 at a location near bracket 45, while guide roller 43 is rotatably mounted on the shaft near bracket 46. Guide rollers 42 and 43 are parallel to one another and are located inwardly of the straight edge of arm 29. Another pair of spaced brackets 48 and 49 are secured to the angled end portion of arm 29 to support a horizontal shaft (not shown) on which camming roller 44 is mounted for rotation at the same elevation as guide rollers 42 and 43. Camming roller 44 is oriented at an angle of approximately 45° relative to guide rollers 42 and 43 and is located inwardly of the angled portion of arm 29.

A horizontal bar 50 formed from a length of angle stock is supported on top of a pair of upright posts 51 and 52 (FIG. 2) which are secured near the edge of platform 16. Bar 50 is parallel to the straight portion of arm 29. A shorter bar 53 which is likewise formed from angle stock is secured to one end of bar 50. Bar 53 is perpendicular to bar 50 and is spaced above one edge of platform section 16*a* to act as a stop in positioning the loose piling section 12 above the set piling section 11.

An upwardly projecting hanger bracket 54 is secured to platform 16 with opposite legs of the bracket angling upwardly from opposite edges of the platform. The horizontal top piece of bracket 54 is spaced considerably above platform 16 and is provided with a U-shape fastener 55. Fastener 55 is adapted to receive a hook 56 (FIG. 2) that is suspended from a crane (not shown). Bracket 54 is located such that the weight of alignment device 10 is distributed equally on either side of the bracket. Fastener 55 is likewise attached to the bracket at a location wherein the weight is equally distributed about the fastener. To further facilitate the manipulation of alignment device 10 by the crane, a weight 57 (FIG. 2) is suspended below the device on a rope 58 which is attached to base 15.

In use, the hook 56 which is suspended from the crane (not shown) is attached to fastener 55 to permit the crane to raise alignment device 10 from the ground and position it on top of the set piling section 11. The guides 23 and 24 are located on opposite sides of section 11 to prevent the device 10 from twisting and to maintain it adjacent the set piling section as it is raised. When the alignment device has been raised above the set piling, the crane operator positions slot 20 over the web 11*a* of the set piling section, with the weight 57 engaging the set piling section and the large V-shaped notches at the bottom ends of slots 20 assisting the crane operator in guiding the slots 20 onto the web 11*a*. The alignment device is then lowered until base 15 rests in a stationary and stable position on top of piling section 11. The size of base 15 is such that ear plates 21 and 22 bear against the curved flanges 11*b* and 11*c* at one edge of piling section 11, and side wall 17 bears against the opposite flanges 11*b* and 11*c* to prevent lateral movement of the device during operation. Also, the close fit between slots 20 and web 11*a* assures that platform 16 is maintained horizontally. As best illustrated in FIG. 4, bar 53 is located directly above the junction of web 11*a* with one set of flanges 11*b* and 11*c*.

With piston rod 36 extended to retain arm 29 in its outermost position and thereby open the jaw mechanism, the tackle 14 of the crane is hooked through the opening 13 in the top of the loose piling section 12 in order to permit the crane to lift section 12 to an upright position. Section 12 is then inserted in the open jaw mechanism somewhat below its top end and in an orientation reversed or at 180° to section 11, as illustrated in FIG. 4. A man stationed at ground level positions the edge of section 12 against the edge of section 11 such that the lip of each piling section contacts both flanges of the other piling section. The controls located at ground level are then operated to retract piston rod 36 and move arm 29 inwardly to close the jaw mechanism on section 12. The crane operator then raises section 12 straight upwardly with guide rollers 42 and 43 rotating against one side of the loose piling section to guide it. The coming roller 44 rotates against the outer edge of section 12 and thereby constantly presses the loose section toward the set section 11 to maintain the edge of section 12 against the edge of section 11.

After section 12 has been raised to an elevation where its bottom end clears the top end of section 11, the force exerted by camming roller 44 against the outer edge of section 12 shifts the loose piling section laterally by camming action until it engages bar 53 and is stopped in the position shown in FIG. 5. In this position, lip 12*d* is located directly above the longitudinal keyway presented between flanges 11*b* and 11*c*, and lip 11*d* is located directly below the keyway between flanges 12*b* and 12*c*. The crane operator then lowers section 12, whereby the mating edges of piling sections 11 and 12 are interlocked. When section 12 has been lowered a sufficient distance to assure that it is interlocked with section 11, cylinder 35 is actuated to extend its piston rod 36 and open the jaw mechanism. After section 12 has been completely lowered to the lake bed, alignment device 10 may be lifted upwardly by the crane to remove it from section 11 and reset the device on the last set piling. As is common in this industry, the sections of piling resting on the lake bed are eventually driven completely down to the bedrock by a conventional pile driver or the like (not shown).

Referring now to FIGS. 8–17, a second embodiment of the sheet piling alignment device is generally designated by reference numeral 60. In FIGS. 9 and 10, a pair of Z-shaped piling sections which have been successively set in upright positions and interlocked at the edges are designated by numerals 61 and 62, and reference numeral 63 indicates a third Z-shaped piling section that has been raised above section 62 and positioned to be interlocked therewith. With reference to FIG. 8 in particular, piling section 61 includes a flat central web 61*a* and a pair of wall portions 61*b* and 61*c* that extend outwardly from web 61*a* on opposite sides thereof at an angle and are substantially parallel to one another. A key or tongue 61*d* is formed on the edge of wall 61*b* and extends the entire length of the piling section. The opposite wall 61*c* has a pair of curved flanges 61*e* and 61*f* formed thereon which cooperate to present a longitudinal keyway or groove of a size to closely receive the tongue of another piling section. As best illustrated in FIG. 9, piling sections 62 and 63 are identical to section 61 and comprise respective central webs 62*a* and 63*a*, walls 62*b*, 62*c* and 63*b*, 63*c*, tongues 62*d* and 63*d*, and curved flanges 62*e*, 62*f* and 63*e*, 63*f*. A circular opening 64 (FIG. 8) is formed through the web of each piling section near the top thereof.

Alignment device 60 includes a base 65 which supports a main horizontal platform 66 thereon. With particular reference to FIG. 14, base 65 includes a stationary leg 67 and a pivotal leg 68 which cooperate to support alignment device 60 on top of set piling section 61. Stationary leg 67 is welded at its top end to a flat mounting plate 69. Mounting plate 69 is in turn bolted flatly by a set of bolts (not shown) against the underside of platform 66 to connect the entire base to platform 66. A number of alternative sets of bolt holes are formed through platform 66 at selected locations to permit base 65 to be oriented at a variety of positions with respect to the platform, depending upon the particular configuration of the piling sections that are to be assembled. These bolts may be removed and reinserted through mounting plate 69 and an alternative set of bolt holes in platform 66 when it is desired to reposition the base relative to the platform.

Referring now to FIG. 15, leg 67 is of generally U-shaped cross section and includes a flat central wall 70 and respective side walls 71 and 72 which extend at right angles from the opposite edges of wall 70. A pair of short ridges 73 and 74 are formed to project from the opposite edges of central wall 70 approximately ⅛ inch beyond the surface thereof. Each ridge 73 and 74 is milled to present a smooth, flat surface. Pivotal leg 68 is also of U-shaped cross section with a central wall 75 and side walls 76 and 77 extending perpendicularly from the edges of the central wall. A pair of ridges 78 and 79 project from the opposite edges of wall 75 toward ridges 73 and 74 and approximately ⅛ inch beyond the surface of wall 75. Ridges 78 and 79 are likewise milled to provide smooth, flat surfaces thereon.

With reference now to FIGS. 10 and 14, the top end of leg 68 has a pair of generally triangular plates 80 and 81 welded to its respective side walls 76 and 77. Plates 80 and 81 extend upwardly beyond the top end of leg 68, and each of the plates is bored near its top end to receive pivot pin 82. Pin 82 extends horizontally between plates 80 and 81 and through a cylindrical sleeve 83 (FIG. 10) which is secured between a pair of flanges that project laterally from the top end of stationary leg 67 and above pivotal leg 68.

A conventional cylinder 84 is provided to pivot leg 68 toward and away from leg 67 about the horizontal axis defined at pivot pin 82. With particular reference to FIG. 10, the bottom end of cylinder 84 is pivotally pinned at 85 to the back side wall 75 and below the center thereof. A pair of angles are welded to the underside of plate 69 with their downwardly projecting flanges against one another to form a T-shaped horizontal arm 86 which extends away from stationary leg 67. The piston rod 87 of cylinder 84 is pinned at its top end to the outer end of arm 86 by a pivot pin 88. Conventional controls (not shown) for cylinder 84 are located at ground level.

A horizontal bar 89 is welded to side wall 71 of the fixed leg 67. Bar 89 projects laterally beyond leg 67 such that it will engage the side of leg 68 when the latter leg is in its closed or vertical position, as illustrated in the solid lines of FIG. 14. Another horizontal bar (not shown) is secured to the opposite side wall 72 of leg 67 and likewise overlaps the closed pivotal leg 68. To accommodate battered and ragged top edges of the piling sections, legs 67 and 68 are each notched in the area adjacently below bar 89 and the similar opposite bar.

With reference to FIGS. 14 and 15, each leg 67 and 68 has mounted thereon four identical gripping assemblies, each of which is generally designated by reference numeral 90. An upper pair of gripping assemblies 90 are spaced laterally apart on wall 70 of leg 67 somewhat below the top thereof to oppose another pair of gripping assemblies 90 which are mounted at corresponding locations on wall 75 of leg 68. Similarly, a lower pair of laterally spaced gripping assemblies 90 are mounted on wall 70 above the bottom thereof in opposition to a pair of gripping assemblies 90 correspondingly located on wall 75. Each of the eight gripping assemblies 90 bears against the web 61*a* of piling section 61 when leg 68 is in its vertical or closed position, as shown in FIG. 15.

Referring now to FIG. 16, the structural details and adjustable mounting of one of the gripping assemblies 90 are illustrated. Wall 75 of leg 68 is bored with an opening 91 at the desired location. A nut 92 is welded to the back side of wall 75 with its internally threaded bore in alignment with opening 91. A bolt 93 having a threaded shank is threaded through nut 92 and extends through opening 91. Bolt 93 is provided with a central bore 94 having a reduced diameter portion 95 at its forward end. A small machine screw 96 is positioned interiorly of bolt 93 with the threaded shank of screw 96 extending through bore portion 95 and the screw head bearing against an internal shoulder presented where bore 94 necks down to form portion 95. The end of screw 96 projects beyond the forward end of bolt 93 to receive a circular disc member 97. A threaded opening extends partially through disc member 97 from the back side thereof to permit the disc member to be threaded onto screw 96. A counterbore is formed in the forward face of bolt 93 to permit disc member 97 to seat in the recessed area thereby presented. A plurality of carbide bosses 98 are fixed on the outer face of disc member 97 to present a gripping surface thereon. Each boss 98 has a pointed outer tip which digs into web 61*a* in order to firmly grip piling section 61. A jam nut 100 is threaded onto bolt 93 and may be tightened against nut 92 to secure bosses 98 in the desired spacing from wall 75.

All eight of the gripping assemblies 90 are constructed identically and all are mounted as described. It is pointed out that the mounting of gripping assemblies 90 on the adjustable bolt 93 permits them to be adjusted inwardly and outwardly of legs 67 and 68. Furthermore, each disc member 97 may be replaced when it becomes worn simply by removing it from screw 96 and threading a new disc member onto the screw. It is preferred that bosses 98 project approximately 1/32 inch beyond ridges 73, 74, 78 and 79 so that when the bosses dig into web 61a, the ridges will bear flatly against the web. The provision of ridges 73, 74, 78 and 79 accommodates ragged edges around the circular opening 64 in piling section 61 so that the ragged metal does not engage walls 70 and 75.

With reference again to FIGS. 14 and 15, rollers are provided on each leg 67 and 68 to assist in the proper positioning of alignment device 60 on top of piling section 61. Side wall 71 of leg 67 has a pair of vertically spaced roller assemblies 102 projecting outwardly therefrom at a location such that the roller assemblies will bear against wall 61c of piling section 61. Side wall 76 of leg 68 has a pair of vertically spaced roller assemblies 104 mounted at corresponding positions thereon. In a similar manner, the opposite side wall 72 of leg 67 is provided with another pair of vertically spaced roller assemblies (one of which is indicated at 105 in FIG. 15), while side wall 77 of leg 68 supports a pair of roller assemblies (one of which is designated by reference numeral 106 in FIG. 15) at positions corresponding to the location of roller assemblies 105 on wall 72. The latter roller assemblies 106 are located to bear against wall 61b of piling section 61 when pivotal leg 68 is closed.

Roller assemblies 102, 104, 105 and 106 are constructed identically, and the structural details of one of the roller assemblies 104 are illustrated in FIG. 17. A metal tube 108 of square cross section and open at both ends is welded to the back side of wall 75. A smaller square tube 109 is closely but slidably received in tube 108 and extends beyond the open front end thereof and through a square opening 110 formed through side wall 76. An end plate 111 is fixed over the front end of tube 109. A large spherical roller 112 is retained in a bearing housing 113 and projects beyond the outer end thereof. Housing 113 is provided with opposite flanges that are attached to end plate 111 by a pair of screws 114. A cup-shaped member 115 is mounted within housing 113 with the side walls of member 115 abutting the side walls of the housing. A plurality of small ball bearings 116 are loosely located between roller 112 and the curved surface of member 115 to provide a rolling surface which permits roller 112 to rotate universally. An end plate 117 is welded over the back end of tube 109 and is provided with a threaded opening which receives a threaded bolt 118. A bracket plate 119 which is welded to the back side of wall 75 at a location offset from tube 108 has an opening through which bolt 118 is freely extended. The head of bolt 118 engages one side of bracket plate 119, while a jam nut 120 is threaded onto the bolt and may be tightened against the opposite side of plate 118 to lock the bolt against rotation. Roller 112 may be extended or retracted relative to side wall 76 by loosening jam nut 120 and rotating bolt 118 appropriately to extend or retract tube 109 in the stationary tube 108. As a result, each roller assembly may be adjusted to the correct position according to the particular size and configuration of the sheet piling that is to be assembled. Furthermore, housing 113 and the associated roller 112 are readily removable from tube 109 by simply removing screws 114.

The main platform 66 comprises a rectangular section 66*a* and a long, relatively narrow section 66*b* which extends integrally therefrom at a right angle, as best illustrated in FIG. 9, so that the platform is substantially L-shaped. A box beam 121 which serves as a stiffener is welded to the top side of platform 66 and extends along the outer edge of section 66*b*. An irregularly shaped template 122 having a contoured edge is bolted to overhang platform section 66*b*. An identically shaped template 123 (FIGS. 10 and 11) is bolted to the underside of section 66*b* directly beneath template 122. A set of six removable bolts 124 extend through bolt holes formed in both templates 122 and 123 and also through identically arranged bolt holes formed in platform section 66*b* to secure the templates to the platform. A spacer (not shown) is preferably inserted between the portions of templates 122 and 123 which overhang platform 66 in order to add rigidity.

Referring particularly to FIG. 9, four roller assemblies 125, 126, 127 and 128 are mounted on template 122, with each roller assembly projecting beyond the contoured edge of the template. Roller assembly 125 is located near the right end of template 122, while roller assembly 126 is oriented at a considerable angle slightly to the right of center on the template. Assembly 127 projects at an angle away from roller assembly 126 at a location to the left of center on template 122, and roller assembly 128 is parallel to assembly 125 at the left end of the template. With reference to FIG. 10, template 123 has four roller assemblies 129, 130, 131 and 132 mounted on its underside at locations directly below assemblies 125 through 128, respectively. Each roller assembly 125 through 132 is constructed identically to the roller assembly 104 previously described and is mounted for adjustment on its template in the manner described in connection with the mounting of assembly 104. As a result, the distance that each roller assembly projects beyond the edges of the templates may be adjusted as desired.

A jaw mechanism which opens and closes upon the loose piling section includes a movable jaw or arm 134 which is best illustrated in FIG. 9. Arm 134 comprises a generally L-shaped horizontal plate having a short base portion which is rounded at its end. A pair of rectangular plates 135 and 136 are secured to the top and bottom of platform section 66*b* at the end thereof. Plates 135 and 136 extend beyond section 66*b* at a right angle and are vertically spaced to receive the rounded base portion of the L-shaped arm 134 therebetween.

Arm 134 is mounted for pivotal movement on a vertical shaft 137. With reference to FIG. 12 in particular, shaft 137 is tubular and extends through aligned bores formed in plate 135 and arm 134. A circular flange 138 is carried centrally on the bottom end of shaft 137 and rotates within a circular opening formed through plate 136. A plurality of bolt openings are spaced around the periphery of flange 138 to receive a series of bolts 139 which are threaded into arm 134 to secure flange 138 against the underside of the arm. A plug 140 is secured within the interior of shaft 137 and above the bottom end thereof to form a lubricant reservoir within the bottom portion of the shaft. A fitting 141 extends through a central opening in flange 138 and communicates with the lubricant reservoir to permit lubricant to be supplied thereto. Respective passages 142 and 143 are formed through the side of shaft 137 to deliver the lubricant from the reservoir to the top and bottom surfaces of arm 134.

Shaft 137 pivots within the central bore of a circular bearing member 144 which is secured to the top of plate 135. A toothed pinion 135 is mounted above bearing member 144 and is lockingly connected to shaft 137 by a key 146. A collar 147 is located above pinion 145 and is provided with a central opening through which shaft 137 extends. A flat block 148 extends downwardly from the edge of collar 147 at a spaced location outwardly of pinion 145. Block 148 has a thin brass wear plate 149 secured to its interior surface by screws 150 that are recessed within the block.

A conventional cylinder 151 is provided to pivot arm 134 about the vertical axis defined at shaft 137. With reference to FIG. 9, one end of cylinder 151 is pinned at 152 to an ear plate projecting inwardly from box beam 121. Suitable fluid lines 153 and 154 connect to cylinder 151 in the usual manner, and the controls (not shown) are operated from ground level to extend and retract the piston rod 155 of cylinder 151. Piston rod 155 carries a rack 156 having teeth that are meshed with the teeth of pinion 145 in order to drive the pinion in response to extension and retraction of piston rod 155. Wear plate 149 engages the back side of rack 156 as shown in FIG. 12 to maintain the rack against pinion 145 as piston rod 155 is extended and retracted to pivot arm 134.

Referring again to FIG. 9, arm 134 has an irregularly shaped template 157 bolted to its top side. The shape of template 157 is complementary to the shape of template 122 such that a contoured space is presented between the edges of templates 122 and 157 of a configuration to accommodate sheet piling sections 62 and 63. Another template 158 (FIG. 11) identical in shape to template 157 is bolted to the underside of arm 134 and directly below template 157. A set of six removable bolts 159 is utilized to bolt both templates 157 and 158 to arm 134. Templates 157 and 158 have six aligned bolt holes arranged in a pattern, while arm 134 has six identically arranged bolt holes that enable bolts 159 to secure templates 157 and 158 to arm 134 in the position shown in FIG. 9. A spacer (not shown) is preferably inserted between the portions of templates 157 and 158 which overhang arm 134 in order to add rigidity.

With continued reference to FIG. 9, template 157 carries four roller assemblies 160, 161, 162 and 163, each of which projects inwardly beyond the contoured edge of the template. Roller assembly 160 is oriented at an angle at the right end of template 157, while assemblies 161 and 162 are parallel to one another on opposite sides of the center of the template. Roller assembly 163 is located near the left end of template 157 and is oriented at an angle. Template 158 likewise carries four roller assemblies (one of which is indicated at 164 in FIG. 11) which are located directly below assemblies 160 through 163. Each roller assembly is constructed and adjustably mounted on its template as previously related in connection with roller assembly 104. As a result, the distance that each roller assembly projects beyond the edges of the templates may be adjusted as desired.

The bottom templates 123 and 158 are provided with respective vertical legs 165 and 166 which are best illustrated in FIG. 11. Leg 165 comprises a pair of spaced, parallel side plates which extend downwardly from template 123 and are bolted at their top ends to a pair of angles secured to the underside of template 123. A vertical plate 167 extends between the side plates at central portions thereof to support a pair of vertically spaced roller assemblies 168 which project inwardly beyond the edges of the side plates. Leg 166 is constructed identically and includes spaced, parallel side plates that are bolted to a pair of angles welded to the bottom of template 158. A vertical plate 169 interconnects the side plates, and a pair of roller assemblies 170 are adjustably mounted on plate 169 at locations in opposition to roller assemblies 168. When arm 134 is closed, roller assemblies 168 are spaced from assemblies 170 such that the respective pairs of rollers bear against the opposite sides of wall 62*c* of piling section 62. Each roller assembly 168 and 170 is constructed and adjustably mounted in the manner previously related in connection with roller assembly 104.

With reference again to FIGS. 8 and 9, a box beam 171 is secured to the top side of arm 134 to act as a stiffener. Box beam 171 extends along the outer edge of arm 134 and projects beyond the arm to overlie platform 66 when the arm is closed, as shown in the solid lines of FIG. 9. An elongate rod 172 retains arm 134 against vertical deflection when the arm is swung outwardly to the open position shown in broken lines in FIG. 9. Rod 172 is connected to the outer end of box beam 171 and extends to a bracket 173 which is clamped to the top end of shaft 137. A small bar 174 is secured near box beam 171 to the top side of arm 134 and projects beyond the edge thereof at an angle of approximately 45°. As best illustrated in FIG. 13, the outward end of bar 174 is tapered on its underside so that it will wedge against the top of platform 66 as arm 134 is closed, thereby assuring that arm 134 and platform 66 are level with one another when fully closed.

Referring to FIG. 13 in particular, a hollow block 175 is welded to the top of platform section 66*a* near the edge thereof. A pad 176 which is preferably formed of rubber or a similar relatively soft substance is secured to the outer end of block 175 by a bolt 177. The head of bolt 177 is located in a recess formed in pad 176, while a washer 178 is embedded in the pad to engage the bolt head. Bolt 177 extends entirely through block 175 and has a nut 179 threaded onto its end and against a washer 180 which engages the inward end of block 175. Arm 134 is cushioned as it is swung closed by engagement of box beam 171 against the soft pad 176. Another block 181 is secured to the top of block 175. Block 181 and box beam 171 are preferably provided with aligned bolt holes (not shown) in order to permit the box beam to be secured against block 181 during shipping of alignment device 60 or when it is otherwise desired to retain the jaw mechanism closed for safety purposes.

With reference to FIGS. 8 and 9, a pair of counterweights 182 and 183 are mounted on platform section 66*a* at selected locations such that the weight of alignment device 60 is substantially evenly distributed. An upright mast 184 comprising an H-beam is secured at its bottom end to platform section 66*a* and provided with eye bolts 185 and 186 near its top end. A guy wire 187 connects to eye bolt 185 and extends to an eye bolt 188 secured to platform section 66*b* at a location adjacent plate 135. A second guy wire 189 extends from eye bolt 190 on counterweight 182. Guy wire 187 prevents vertical deflection on platform section 66*b*, while a counterbalancing effect on mast 184 is provided by guy wire 189.

A triangular plate 191 extends upwardly from platform section 66*a* at the center of weight of alignment device 60. Plate 191 is provided with an opening which is adapted to receive a hook 192 (FIG. 8) that is suspended from a crane (not shown) in order to permit the crane to manipulate alignment device 60.

In use, alignment 60 is initially positioned on top of set piling section 61. Piston rod 87 of cylinder 84 is retracted to hold leg 68 in the open position shown in broken lines in FIG. 14, and the crane (not shown) is utilized to lower base 65 onto the top of web 61*a* with legs 67 and 68 on opposite sides of the web. If the top edge of section 61 is even, platform 66 will be oriented in a horizontal position with bar 89 and the corresponding bar (not shown) on the opposite side of base 65 both resting on top of web 61*a*. However, if the set piling section presents a top edge that is battered or otherwise uneven, only one of these bars will rest on the set piling with platform 66 oriented horizontally. It is pointed out that the notches in legs 67 and 68 adjacently below bar 89 and the corresponding opposite bar are large enough to accommodate any ragged metal projecting from the top edge of section 61. As leg 68 pivots to a closed position, roller assemblies 102 and 106 bear against the respective walls 61*c* and 61*b* of the piling section and thereby force the base 65 into parallel alignment with the piling so that the platform will be perpendicularly to the piling even if the upper edge thereof is irregular. When leg 68 is completely closed, the bosses 98 of gripping assemblies 90 bite into each side of web 61*a* in order to maintain the alignment device 60 in a stationary position. As previously mentioned, the flat ridges 73, 74, 78 and 79 bear against web 61*a* when leg 68 is completely closed, and the ridges provide clearance for any ragged edge around opening 64.

After alignment device 60 has been positioned on piling section 61, section 62 which is initially loose, is raised above the ground to an upright position by the crane. With the piston rod 155 of cylinder 151 retracted to hold arm 134 in the open position shown in broken lines in FIG. 9, section 62 is inserted within the open jaw mechanism somewhat below its top end and in an orientation reversed or at 180° with respect to section 61. A man stationed at ground level positions tongue 62*d* against the edges of both flanges 61*e* and 61*f* of piling section 61. Piston rod 155 is then extended, although not to its full extension. Arm 134 is thereby moved inwardly to a partially closed position wherein the roller assemblies on the right side of templates 122 and 123 engage one side of piling section 62 and the roller assemblies on the right side of templates 157 and 158 engage the opposite side of section 62. These roller assemblies thereafter roll against piling section 62 to guide it as it is raised by the crane. Roller assemblies 126 and 130 bear against web 62*a* at an angle and thereby continuously press section 62 toward section 61. The resulting camming action provided by roller assemblies 126 and 130 maintains tongue 62*d* against flanges 61*e* and 61*f* as section 62 is raised within the jaw mechanism.

After section 62 has been raised sufficiently so that its bottom end clears the top end of section 61, piston rod 155 is fully extended to completely close arm 134 to the position shown in solid lines in FIG. 9. Since the edge of section 62 is now free of section 61, the angled roller assemblies 126 and 130 exert a camming force on web 62*a* which shifts section 62 laterally. When roller assemblies 126 and 130 reach the angled junction of web 62*a* with wall 62*c*, roller assembly 160 and the corresponding roller assembly (not shown) on template 158 simultaneously reach the angled junction of web 62*a* with wall 62*b*, thereby stopping the lateral movement of section 62. At this point, tongue 62*d* is aligned directly above the keyway presented between flanges 61*e* and 61*f* of piling section 61. The crane operator then lowers section 62 to interlock it with section 61 as tongue 62*d* enters the groove between flanges 61*e* and 61*f*. After section 62 has been lowered sufficiently to assure its proper connection to section 61, arm 134 is again pivoted outwardly to open the jaw mechanism. Section 62 is thereafter completely lowered.

Piling section 63 is then assembled with alignment device 60 remaining in position on top of section 61. The crane operator raises section 63 from the ground by the opposite end from that of section 62 (i.e., 180° longitudinally) in order to reverse the orientation of the piling as shown in FIG. 9. With the section 63 placed within the open jaw mechanism, a man stationed at ground level positions tongue 63*d*against the edges of flanges 62*e* and 62*f*. Piston rod 155 is then extended, although not completely, to partially close arm 134 on piling section 63. The roller assemblies 168 and 170 on legs 165 and 166 engage opposite sides of wall 62*c* as shown in FIG. 11 in order to maintain the jaw mechanism in the proper orientation with respect to piling section 62 and to counteract any tendency of piling section 62 to twist. The roller assemblies on the left half of templates 122, 123, 157 and 158 engage section 63 and roll against section 63 to guide it as it is raised by the crane. Roller assembly 163 and the roller assembly that is located directly therebelow press against web 63*a* at an angle to provide camming action which maintains tongue 63*d* against the edge of section 62.

When section 63 has been raised completely above section 62, arm 134 is fully closed, whereupon roller assembly 163 and the corresponding roller assembly on template 158 cam against web 63*a* to shift section 63 laterally toward section 62. These roller assemblies reach the angled junction between web 63*a* and wall 63*c* at the same time that roller assemblies 127 and 131 reach the junction of web 63*a* with wall 63*b*. Section 63 is thereby stopped and positioned with its tonuge 63*d* aligned directly above the keyway between flanges 62*e* and 62*f*, as shown in FIGS. 9 and 10. The mating edges of sections 62 and 63 are thus able to interlock as section 63 is lowered by the crane.

After section 63 has been set, alignment device 60 is moved onto the top thereof in order to assemble two additional piling sections. Piston rod 87 is retracted to pivot leg 68 away from piling section 61. The crane operator is then able to raise base 65 from web 61*a* and move alignment device 60 over and install it on top of section 63 in the manner previously related.

Alignment device 60 is adapted for use in assembling sheet piling sections having configurations other than the Z-shaped piling sections shown in FIGS. 8–17. For example, FIG. 18 illustrates the alignment device supported on top of a set piling section 195 having a substantially flat shape. A second flat piling section which has been interlocked at one edge with section 195 is designated by reference numeral 196, while numeral 197 designates a third flat piling section that has been interlocked with the edge of section 196.

With continued reference to FIG. 18, piling section 195 comprises a straight, flat web 195*a* having a pair of curved flanges 195*b* and 195*c* at each longitudinal edge. Each pair of flanges 195*b* and 195*c* cooperate to define a longitudinal groove therebetween. Each flange 195*b* has an enlarged lip 195*d* on its edge which is sized to fit closely within the groove of another piling section. Piling sections 196 and 197 are constructed identically to section 195 and comprise respective flat webs 196*a* and 197*a*, curved flanges 196*b*, 196*c* and 197*b*, 197*c*, and lips 196*d* and 197*d* on each flange 196*b* and 197*b*.

To permit alignment device 60 to be used in the assembly of piling sections of various configurations, a plurality of alternative sets of templates are provided, with each alternative set of templates being interchangeable with templates 122, 123, 157 and 158. As previously suggested, the removal of the two sets of bolts 124 and 159 permits the templates to be removed. FIG. 18 illustrates alignment device 60 with templates 122, 123, 157 and 158 having been removed and a first alternative set of templates having been substituted therefor. This alternative set of templates includes a first template 200 which has an irregular edge and is bolted to the top side of the platform section 66*b* in place of template 122 and a second template (not shown) which is shaped identically to template 200 and bolted to the underside of platform section 66*b* in place of template 123. Each of these alternative templates is provided with six holes that are arranged in a selected pattern which matches the six bolt holes in platform section 66*b* to permit bolts 124 to secure the templates to the platform in the position shown in FIG. 18. The first alternative set of templates further includes a third template 201 which is bolted to the top side of arm 134 in place of template 157 and a fourth template (not shown) which is substituted for template 158 on the bottom side of arm 134. These latter two templates are each provided with six bolt holes that are arranged to match with the bolt holes in arm 134 such that bolts 159 are able to secure the templates to arm 134 in the position of FIG. 18. With arm 134 closed, the space presented between the edges of templates 200 and 201 is of a size and shape to accommodate piling sections 196 and 197, as shown in FIG. 18.

Four roller assemblies 202, 203, 204 and 205 are mounted on template 200, with each roller assembly projecting beyond the irregular edge of the template. Roller assemblies 202 and 203 are parallel and are located on the right half of template 200, while assemblies 204 and 205 are angled in opposite directions on the left half of template 200. The template (not shown) located below template 200 carries four roller assemblies (not shown) which are located directly below roller assemblies 202, 203, 204 and 205. Template 201 also carries four roller assemblies 206, 207, 208 and 209, each of which projects inwardly beyond the edge of the template. Templates 206 and 207 are angled in opposite directions on the right half of template 201, while assemblies 208 and 209 are parallel to one another on the left half of template 201. The template (not shown) mounted below template 201 likewise carries four roller assemblies (not shown) which are located directly below roller assemblies 206, 207, 208, and 209. Each roller assembly is constructed and adjustably mounted on its template in the manner previously described in connection with roller assembly 104. As a result, the distance that each roller assembly projects beyond the edge of the template can be adjusted as desired.

To use alignment device 60 in the assembly of flat piling sections, the mounting plate 69 which supports base 65 is repositioned on the underside of platform 66 such that the jaw mechanism will be located as shown in FIG. 18 when base 65 is positioned on top of piling section 195. In this regard, the previously described alternative sets of bolt holes in platform 66 permit mounting plate 69 to be removed and rebolted to the platform in the desired position. The crane (not shown) is then utilized to lower base 65 onto the top of web 195*a* with platform 66 maintained horizontally and piston rod 87 retracted to separate legs 67 and 68. After base 65 has been completely lowered, piston rod 87 is extended to close leg 68 and cause gripping assemblies 90 to bite into web 196*a*. It is pointed out that the roller assemblies 104 and 106 mounted on opposite sides of leg 68 ar adjustable in position so that they are able to bear against the flanges 195*c* on opposite edges of section 195 to assure that base 65 is positioned properly.

With arm 134 held in its open position, piling section 196, which is initially loose, is raised from the ground by the crane and inserted within the open jaw mechanism below its top end and in an orientation reversed or at 180° with respect to section 195. A man stationed at ground level positions the edge of section 196 against the edge section 195 such that the lips 195*d* and 196*d* contact the edges of each curved flange of the other piling section. Piston rod 155 is then extended somewhat less than its full extension to move arm 134 inwardly to a partially closed position. Roller assemblies 202 and 203 bear against one side of section 196, while roller assemblies 206 and 207 come into engagement with the opposite side of section 196. These roller assemblies thereafter guide section 196 as it is raised within the jaw mechanism by the crane. Roller assembly 206 bears against flange 196*c* at an angle to press section 196 toward section 195 by camming action and thereby retain the edges of the two piling sections in contact.

After section 196 has been raised sufficiently to clear section 195, arm 134 is closed completely such that roller assembly 206 cams against the curved surface of flange 196*c* to shift section 196 laterally. When roller assemblies 206 and 207 have reached the junctions of web 196*a* with the respective flanges 196*c*, section 196 is stopped and located with its lip 196*d* aligned directly above the groove presented between flanges 195*b* and 195*c*. Section 196 is then lowered to interlock with the edge of section 195.

With base 65 remaining on piling section 195, section 197 is raised by the crane and inserted within the open jaw mechanism and positioned below its top end and in an orientation reversed or at 180° with respect to section 196. A man stationed at ground level positions section 197 with its lip 197*d* against the edges of flanges 196*b* and 196*c*, and with lip 196*d* against the edges of flanges 197*b* and 197*c*. The jaw mechanism is then partially closed on section 197 to engage roller assemblies 204 and 205 against one side of section 197 and roller assemblies 208 and 209 against the opposite side of the piling section. The camming action provided by roller assembly 204 bearing against flange 197*c* at an angle retains the edge of section 197 against the edge of section 196 as section 197 is raised by the crane within the jaw mechanism. After section 197 has been raised completely above section 196, the jaw mechanism is fully closed, and the camming action of roller assembly 204 against the curved surface of flange 197*c* shifts section 197 laterally to align its tongue 197*d* above the groove presented between flanges 196*b* and 196*c*. Section 197 is then lowered by the crane to interlock its edge with the edge of section 196 prior to opening arm 134. Section 197 is eventually set, and alignment device 60 may then be moved over on top of it to assemble two additional piling sections.

Turning now to FIG. 19, alignment device 60 is illustrated in position to assembly sheet piling sections of still another configuration. The alignment device is positioned on top of a first piling section 210 of the arch web type which is set in an upright posture. A second arch web piling section 211 is interlocked at one edge iwth section 210, while a third arch web piling section 212 is interlocked with the opposite edge of section 211. Piling section 210 is generally arch shaped and includes a flat central web 210*a*. A pair of walls 210*b* and 210*c* angle away from the web 210*a* at the opposite edges thereof. The longitudinal edge of each wall 210*b* and 210*c* is provided with a pair of curved flanges 210*d* and 210*e* which present a longitudinal groove therebetween. Each flange 210*d* has an enlarged lip 210*f* on its edge which is sized to fit closely within the longitudinal groove of another piling section. Arch web piling sections 211 and 212 are identical to section 210 and comprise respective central webs 211*a* and 212*a*, walls 211*b*, 211*c* and 212*b*, 212*c*, curved flanges 211*d*, 211*e* and 212*d*, 212*e* on each wall, and enlarged lips 211*f* and 212*f* on each flange 211*d* and 212*d*. A circular opening is formed through each piling section near the top of its web to receive tackle that is carried by the crane.

With continued reference to FIG. 19, a second alternative set of templates has been mounted on alignment device 60 in order to assemble the arch web piling sections. The second alternative set of templates includes a first template 213 which has an irregular edge and is bolted to the top of platform section 66*b* and a second template (not shown) which is shaped identically to template 213 and is bolted to the underside of platform section 66*b*. Bolt holes are formed in these templates to match with the bolt hole pattern in platform section 66*b* so that bolts 124 are able to secure the templates to the platform. The second set of templates further includes a third template 214 which is bolted to the top of arm 134 and a fourth template (not shown) which is shaped identically to template 214 and is bolted to the underside of arm 134. Bolt holes formed through the third and fourth templates match with the bolt hole pattern of arm 134 so that bolts 159 can be utilized to secure the templates to arm 134. When arm 134 is closed as shown in FIG. 19, templates 213 and 214 present an irregularly shaped space therebetween of a size to accommodate arch web piling sections 211 and 212.

Template 213 has mounted thereon four roller assemblies 215, 216, 217, and 218, each of which projects beyond the irregular edge of the template. Roller assemblies 215 and 216 are angled in opposite directions on the right side of template 213, while roller assemblies 217 and 218 are parallel to one another on the left side of template 213. The template on the underside of platform section 66*b* is also provided with four roller assemblies (not shown) that are located directly below assemblies 215, 216, 217 and 218. Arm 214 likewise carries four roller assemblies 219, 220, 221, and 222, with each of these roller assemblies projecting beyond the irregular edge of template 214. Roller assemblies 219 and 220 are parallel to one another on the right side of template 214, and roller assemblies 221 and 222 are mounted to angle away from one another on the left side of template 214. The template that is bolted beneath template 214 on the underside of arm 134 also carries four roller assemblies (not shown) that are located directly below roller assemblies 219, 220, 221, and 222. Each of the roller assemblies is constructed and adjustably mounted on its template in the manner previously described in connection with roller assembly 104.

To use alignment device 60 in the assembly of arch web piling sections, the mounting plate 69 that supports base 65 is bolted to the underside of platform 66 at a position such that the jaw mechanism will be located as shown in FIG. 19 when base 65 is positioned on the top of piling section 210. With leg 68 in its open position, the crane is used to lower legs 67 and 68 on opposite sides of web 210*a*. After base 65 has been lowered onto the top of web 210*a*, leg 68 is closed to cause gripping assemblies 90 to bite into the opposite sides of web 210*a*. The roller assemblies 102 and 105 located on the opposite sides of leg 67 bear against walls 210*c* and 210*b* to cooperate in properly positioning the base on piling section 210.

Piling section 211, which is initially loose, is raised by the crane and inserted within the open jaw mechanism somewhat below its top end and in an orientation reversed or at 180° with respect to section 210. A man stationed at ground level positions section 211 such that lip 211*f* is against the edges of flanges 210*d* and 210*e* and lip 210*f* is against the edges of flanges 211*d* and 211*e*. Arm 134 is then partially closed such that roller assemblies 215 and 216 engage one side of section 211 and roller assemblies 219 and 220 come into engagement with the opposite side of section 211. As section 211 is thereafter raised within the jaw mechanism by the crane and guided by the various roller assemblies, roller assembly 215 bears against wall 211*c*at an angle to retain the edge of section 211 against the edge of section 210 by camming action. After section 211 has cleared the top of section 210, the camming action of roller assembly 215 against wall 211*c* shifts piling section laterally until roller assembly 215 is located at the angled junction of web 211*a* with wall 211*c* and roller assembly 216 is located at the angled junction of web 211*a* with wall 211*b*. At this point, lip 211*f* is aligned directly above the groove between flanges 210*d* and 210*e*, and lip 210*f* is directly below the groove between flanges 211*d* and 211*e*. Section 211 interlocks with the edge of section 210 as it is lowered by the crane and eventually set in upright position.

With alignment device 60 remaining in its position on top of piling section 210, section 212 is raised from the ground and inserted within the open jaw mechanism somewhat below its top end and in orientation reversed or at 180° with respect to section 211. Section 212 is positioned by a man stationed at ground level with its lip 212*f* against flanges 211*d* and 211*e*, and with lip 211*f* against flanges 212*d* and 212*e*. Arm 134 is then partially closed on piling section 212 such that rollers 217, 218, 221 and 222 bear against opposite sides of the piling section to guide it as it is raised by the crane. The camming action provided by roller assembly 221 engaging wall 212*b* at an angle retains the edge of section 212 against the edge of section 211. When section 212 has cleared the top end of section 211, arm 134 is fully closed, and the camming action of roller assembly 221 against wall 212*b* shifts section 212 laterally until it is stopped when roller assemblies 221 and 222 reach the position shown in FIG. 19. Since lip 212*f* is then aligned directly above the groove between flanges 211*d* and 211*e*, and lip 211*f* is directly below the groove between flanges 212*d* and 212*e*, section 212 can be lowered to interlock with section 211.

It is pointed out that the guide roller assemblies disclosed herein permit successive piling sections to be connected at a slight angle relative to one another corresponding to the degree of play permitted the interlocked edges of the piling sections. Consequently, alignment device 60 enables the piling to be arranged to form a round cofferdam or other curved structure. In addition, the rack and pinion drive mechanism which opens and closes arm 134 is particularly advantageous in that the toothed engagment of rack 156 with pinion 145 facilitates the movement of the jaw mechanism to a partially closed position as a loose piling section is raised therewithin.

As those skilled in the art will recognize, modifications in the structure and mounting means of the movable jaw or arm of the jaw mechanism can be made without detracting from the advantages obtained by the invention. For example, it has been found equally desirable to mount the movable jaw to the main platform for movement about a horizontal hinge axis to open and close on the loose piling section. It is further contemplated that base 65 can be constructed in a manner that enables it to rest on top of the set piling at a position other than on the web portion thereof. It is also recognized that difficulty may be encountered in accurately positioning a loose piling section if the initial set piling section is inverted with respect to the position of the Z-shaped piling section 61 shown in FIG. 9. Consequently, it is contemplated that a pair of jaw mechanisms may be included at opposite ends of the main horizontal platform, with the two jaw mechanisms constructed such that one of them is able to accurately position a loose piling section regardless of the particular orientation of the initially set section. The third embodiment of my invention now to be described is illustrative of the foregoing modifications.

Referring to FIGS. 20–25, the sheet piling alignment device is provided with such a double jaw arrangement and each jaw opens and closes about a horizontal hinge axis. The device is generally designated by reference numeral 225. This third embodiment is constructed to assemble piling sections in either direction from the set piling section, and the device is therefore, symmetrical about a central transverse axis. In other words, the opposite halves of the device are substantially mirror images of one another.

FIGS. 20–25 illustrate the device 225 equipped to assemble arch web piling sections of the same type shown in FIG. 19. Accordingly, the set arch web section of which the device is supported is designated by numeral 210, the section which is interlocked with one edge of section 210 is designated by numeral 211, and a third section which is being interlocked with section 211 is designated by numeral 212. The various portions of sections 210, 211, and 212 are designated by the same reference characters in FIGS. 20–25 as in FIG. 19.

The third embodiment includes a main platform 226 which is generally in the shape of an "H" and which is oriented horizontally during use. Box beams 227 and 228 are secured to the upper surface of platform 226 along the respective side edges thereof to stiffen and strengthen the platform. Transverse box beams 229 and 230 are secured to extend between beams 227 and 228 on opposite sides of the transverse center line of the platform. An upright block 231 is mounted to platform 226 between beams 227 and 228 at the geometric center of the platform. At opening 231*a* (FIG. 20) is formed through block 231 to receive the hoisting tackle of a crane (not shown) that is used to move the device. Reinforcing plates 232 extend between beams 229 and 230 and block 231 to strengthen the connection of the block to the platform.

With particular reference to FIG. 21, a pair of contoured templates 233 are bolted to the upper surface of platform 226 on opposite sides of the transverse center line thereof. The templates 233 have contoured edges which are shaped generally in accordance with the shape of a pair of interlocked arch web piling sections. The contoured edge of the template on one side of the platform is reversed relative to that on the other side; i.e., the opposite templates 233 are mirror images of one another when installed on the platform, as shown in FIG. 21. This construction is economical because the templates may be constructed identically and inverted relative to one another when installed on the platform.

Each template 233 has mounted thereon a plurality of roller assemblies which project inwardly beyond the contoured edge of the template. The roller assemblies are elevated above the templates on top of mounting blocks 234 (FIG. 20), and each roller assembly includes a roller that is supported for rotation about a horizontal axis to assist in guiding the piling sections that are being assembled.

Three roller assemblies 235, 236 and 237 are mounted on the half of each template 233 that is located nearest the center of the platform. The roller assembly 235 on the template 233 located on the right side of the platform (as viewed in FIG. 21) extends at an angle so that its roller is able to bear substantially flatly against wall 211*b* of piling section 211. Roller assembly 236 is located to bear against web 211*a*, while assembly 237 projects at an angle such that its roller engages wall 211*c*. The corresponding roller assemblies 235, 236 and 237 on the left template 233 are positioned at corresponding locations but opposite orientations in order to guide a piling section that is being assembled to the left edge of section 210.

The right half of the right hand template 233 is provided with two roller assemblies 238 and 239 which are angled to engage walls 212*c* and 212*b*, respectively, of piling section 212. Corresponding roller assemblies 238 and 239 on the left half of the left template 233 are correspondingly located to engage a piling section that is to be assembled in the area of the left end of the platform.

A pair of lower templates 241 (FIG. 20) having contoured edges are bolted to the underside of platform 226 at locations directly beneath templates 233. Templates 241 are each equipped with a plurality of roller assemblies that generally underlie the roller assemblies on the upper templates 233. One of the roller assemblies on each template 241 is indicated at 242 in FIG. 21, and these assemblies 242 are offset somewhat from assemblies 236.

FIG. 25 illustrates in detail the construction and adjustable mounting of each of the roller assemblies. Each assembly includes a roller 244 which is mounted for rotation on a horizontal axle 245 that is supported between a pair of spaced bracket plates 246. Plates 246 extend from a square tubular member 247 which is received for axial sliding within a slightly larger square tube member 248. Member 248 is secured to an open mounting bracket 249 which is welded to the block or other member to which the roller assembly is mounted. A bolt 250 extends through the back plate 249*a* of mounting bracket 249 and is threaded through a threaded opening formed in the back plate 247*a* of member 247. Bolt 250 may be turned by its head in order to extend or retract member 247 and thereby adjust the extent to which roller 244 projects from the mounting bracket 249. A nut 251 is tightened down on bolt 250 against the opposite surface of plate 249*a* from the bolt head in order to secure the bolt in place. The open bracket 249 permits ready access for loosening nut 251 when bolt 250 is to be adjusted.

As best shown in FIGS. 20 and 22, each of the upper templates 233 has a pair of upright masts 253 mounted thereon. Each mast 253 supports two or more vertically spaced roller assemblies 254 which are constructed and adjustably mounted in the same manner as the roller assemblies illustrated in FIG. 25. Assemblies 254 are each located well above platform 226, and their rollers are positioned for engagement with the flanges 212*e* of piling section 212, as best shown in FIG. 21.

A pair of hinged, flap-type jaw mechanisms cooperate with the respective templates 233 and the roller assemblies thereof in guiding the piling sections that are being assembled. The two jaw mechanisms are located on opposite halves of platform 226 in opposition to the respective templates 233. Each jaw includes a flat plate 255 which has a contoured edge that cooperates with the contoured edge of template 233 in presenting a space shaped to accommodate the arch web piling sections, as best shown in FIG. 21.

Six roller assemblies are mounted on each plate 255 to guide the piling sections during assembly thereof. The plate 255 on the right side of the platform (as viewed in FIG. 21) is provided with three roller assemblies 256, 257 and 258 on its left half and three roller assemblies 259, 260 (FIG. 20), and 261 on its right half. Assembly 256 is angled so that its roller is able to engage flange 211*e* in order to assist in the guiding of piling section 211. Assembly 257 extends at an angle to bear against wall 211*b*, while roller assembly 258 is positioned to engage web 211*a*. Roller assemblies 259 and 261 are angled to bear against the respective walls 212*c* and 212*b* of section 212, and assembly 260 bears against web 212*a*. The roller assemblies 256–261 on the left hand plate 255 are located at corresponding positions but opposite orientations in order to assist in guiding the piling sections that are assembled to the left edge of section 210.

A horizontal mounting plate 262 is secured to the top of roller assemblies 259–261 on each plate 255. Upright masts 263 are mounted to extend upwardly from the respective plates 262. Each mast 263 is formed from a section of arch web piling, comprising the web and portions of the opposed walls thereof. The masts 263 are therefore shaped in conformity with the piling sections that are being assembled and are able to assist the rollers in guiding piling section 212, as best shown in FIG. 21. Pads 264 are secured to the web portion of each mast 263 in order to cushion the contact between the piling sections and masts.

Each mast 263 is braced on its back side by a large brace 265 that angles downwardly to plate 255 from a location near the top of the mast. Smaller braces 266 angle from each side of each mast downwardly to mounting plate 262.

The plates 255 of the jaw mechanisms are each supported to open and close about a horizontal hinge axis. Each plate 255 is welded at the edge opposite its contoured edge to an elongate tubular hinge 267 which is sleeved over a horizontal shaft 268 in a manner to pivot about the shaft axis. Shaft 268 is supported at its opposite ends on bracket plates 269 that are secured to box beam 228 and to platform 226. The downward pivoting of each plate 255 is limited by a horizontal bar 270 that is secured to the top of a block 271 mounted on top of plate 255. When plates 255 reach a substantially horizontal position, further downward pivoting is prevented due to engagement of the bars 270 with the respective cross beams 229 and 230.

A power cylinder 272 serves to open and close the jaws. The piston rod of cylinder 272 is pinned at 273 to an upstanding ear plate 274 of plate 255. The other end of the cylinder is pinned at 275 to an ear plate 276 which is secured to an upright post 277 at a location well above platform 226. The lower end of each post 277 is mounted on the outer end of a horizontal support bar 278 which is in turn mounted on top of a large beam 279 that is welded to extend outwardly from box beam 228. An inclined brace 280 extends downwardly from each post 277 to connection with the inward end of the corresponding support bar 278. Cylinder 272 may be retracted to pivot plate 255 upwardly, thus opening the jaw, and extended to pivot the plate downwardly, thus closing the jaw.

It is contemplated that only one cylinder 272 will be provided since the piling sections will be assembled by only one jaw at a time. The cylinder 272 may be readily moved from one jaw to the other if it is desired to employ the other jaw in assembling the piling.

With reference to FIGS. 20 and 22, a leg 282 in the form of a square tube is secured to the underside of each beam 279 to essentially form a downward continuation of the corresponding post 273. A brace 282*a* angles downwardly from beam 279 to leg 282. A bar 283 is inserted and secured in the lower end of each leg 282 to form a downward extension thereof. A nut and bolt assembly 283*a* is fit through leg 282 and through one of a number of openings in bar 283 to secure the bar to the leg. A horizontal bar 284 is secured to extend outwardly from the lower end of bar 283, and a brace 285 angles between each pair of bars 283 and 284. A mounting block 286 is secured to the underside of each bar 284 near the outer end thereof. One end of a power cyliner 287 is pivotally pinned to block 286, and the piston rod of the cylinder is pinned at 287*a* to an ear plate 288 of a pivotal alignment 289. As shown in FIG. 22, the top end of leg 289 is pivotally pinned at 290 between a pair of bracket plates 291 which are secured to the underside of platform 226.

A pair of roller assemblies 292 are carried on a short beam member 293 which is mounted on the lower end of leg 289. Each roller assembly 292 is constructed and adjustably mounted in the same manner as that illustrated in FIG. 25. Extension of cylinder 287 pivots alignment leg 289 inwardly to move its roller assemblies 292 against the web of piling section 211, as shown in solid lines in FIG. 22. It is contemplated that only one cylinder 287 will be provided, and that an idle bar 294 (FIG. 20) will be connected between the block 286 and the alignment leg 289 which is not in use.

A stationary leg 295 cooperates with each of the legs 289 for alignment of the piling sections. Legs 295 are secured to extend below each of the lower templates 241 on the opposite side of the piling from legs 289. The upper end of each leg 295 is bolted at 296 between a pair of mounting plates 297 on the underside of each template 241. Each leg 295 carries a plurality of vertically spaced roller assemblies 298 which are constructed and adjustably mounted in the same manner as the roller assembly illustrated in FIG. 25. Roller assemblies 298 bear against the opposite side of the web of piling section 211 from the side engaged by the roller assemblies 292 of the alignment leg 289.

Referring now to FIG. 23 in particular, a pivotal support leg 300 is provided substantially centrally on the underside of platform 226. Leg 300 serves to firmly mount the platform in a stationary position on top of the set piling section 210. The upper end of leg 300 is welded between a pair of triangular bracket plates 301 which are pivotally pinned at 302 to a vertical plate 303. Plate 303 extends below a horizontal mounting plate 304 which is bolted to extend transversely along a central portion of the underside of platform 226 by bolts 305. Leg 300 is in the form of a channel section which is provided near its lower end with an ear plate 306 to which the piston rod of a power cylinder 307 is pinned at 307*a.* The opposite end of cyliner 307 is pinned at 308 within an open box like structure 309 that is mounted on the lower end of a vertical H-beam 310. The upper end of beam 310 is secured to the end of mounting plate 304 that projects outwardly beyond platform 226. A brace 311 angles from beam 310 at its lower end to connection with plate 303 at its upper end.

A plurality of roller assemblies 313 are carried on the opposite flanges of the support leg 300. The rollers 313 are mounted on top of triangular supports 314 which are welded to the opposite sides of leg 300. Preferably, there are two roller assemblies 313 mounted to each side of leg 300 near the top and bottom ends thereof. A roller guard 315 is secured to each support 314 at a position underlying each roller 313. The edge of guard 315 extends to the outward periphery of the roller, and the lower surface of each guard 315 is inclined or tapered away from the roller so that it will cam against the top edge of the piling section upon which the machine is being positioned in order to center the machine on the set piling section.

Each of the roller assemblies 313 is constructed and adjustably mounted like the roller assembly shown in FIG. 25, except that the rollers of assemblies 313 are supported for rotation about vertical axes. As best shown in FIG. 24, rollers 313 are located such that when cylinder 307 is extended to move leg 300 against the set piling section 210, the rollers engage the angled walls of the piling section and are able to act in camming fashion to center the machine laterally with respect to the piling section. At the centered position, the web of leg 300 bears flatly against the web of piling section 210.

A stationary support leg 316 opposes the pivotal support leg 300 on the opposite side of the set piling section 210 in order to assist in supporting the machine on section 210. Leg 316 is bolted at its upper end in the underside of mounting plate 304 and is formed from a section of arch web sheet piling. As best shown in FIG. 24, leg 316 comprises the web and portions of the angled walls of a piling section and is thus able to mate with the shape of the set section 210. Leg 316 is provided with pads 317 on its web portion in order to cushion its engagement with piling section 210. Extension of cylinder 307 pivots leg 300 inwardly to tightly engage piling section 210 between it and leg 316, thereby firmly supporting platform 226 in a stable horizontal position on top of the set piling section.

A safety locking mechanism is provided to maintain the platform in its stationary position on top of the set piling even if cylinder 307 should lose power. With particular reference to FIG. 23, one end of a safety arm 319 is pivoted at 319*a* within a bracket 320 formed on leg 300 somewhat above the lower end thereof. At a substantially central location along its length, arm 319 has an ear plate 321 to which the piston rod of a power cylinder 322 is pivoted. The top end of cylinder 322 is pivoted at 322*a* to an ear plate 323 on the underside of plate 304. Arm 319 is of sufficient length to extend from leg 300 to engagement at its free end with the web of H-beam 310 when leg 300 is pivoted to its inward or closed position, as shown in solid lines in FIG. 23. In this position, the free end of arm 319 rests on top of a stop 324 formed on H-beam 310. The stop 324 prevents arm 319 from pivoting downwardly beyond a locking position wherein the arm is horizontal or inclined slightly from horizontal. With arm 319 extending rigidly between leg 300 and beam 310, leg 300 is unable to pivot outwardly and the safety mechanism thus assures that the device can not move from its stationary position on top of the set piling in the event of a malfunction of cylinder 307.

Cylinder 322 can be retracted in order to pivot arm 319 upwardly to the broken line position of FIG. 23 which permits leg 300 to be pivoted outwardly when it is desired to move the device to a different piling section. Cylinders 307 and 322 are operated from a common valve which controls the fluid flow to and from the cylinders in a manner such that the cylinder with the least resistance is actuated prior to the other cylinder. Accordingly, when the machine is to be moved, cylinder 322 is retracted first to pivot arm 319 upwardly, and cylinder 307 then retracts to pivot leg 300 away from the piling. When leg 300 is pivoted inwardly toward the piling, the two cylinders 307 and 322 extend substantially simultaneously so that leg 300 engages the set piling section at the same time that arm 319 reaches stop 324.

When the alignment device is being moved from one set piling section to another, a guide bar 325 (FIGS. 23 and 24) may be employed to assist in guiding the device properly onto the piling. Guide bar 325 is an elongate horizontal member supported on the inner ends of braces 326 which are connected at their outer ends to the lower end of a generally vertical pivot leg 327. Intermediate its ends, leg 327 is pivotally pinned at 328 between a pair of mounting plates 329 which are welded to extend outwardly from the web portion of the stationary support leg 316. Brace plates 330 (FIG. 24) reinforce the connection of plates 329 to leg 316.

Near its upper end, the pivot leg 327 is provided with an ear plate 331 to which the piston rod of a power cylinder 332 is pinned at 333. The opposite end of cylinder 332 is pinned at 334 to the stationary leg 316. Cylinder 332 acts to pivot leg 327 about pin 328 in order to move guide bar 325 against the sheet piling. As best shown in FIG. 24, bar 325 is preferably long enough to engage the set section 210 and the piling sections on each side thereof to assist in aligning the device properly when it is being lowered onto the set piling.

With particular reference now to FIGS. 22 and 23, a three sided funnel structure 335 is mounted on each side of the transverse center line of platform 226. The funnels 335 act to positively guide piling section 211 into aligned relation above the marginal edge of the set piling section 210 for interlocking therewith. The respective funnels 335 are supported on horizontal mounting arms 336 which are welded on the lower ends of vertical mounting brackets 337 that extend below plate 304.

Each funnel 335 includes a vertical back plate 338 which is welded to arm 336. A base 339 in the general shape of a "U" having a cutout portion extends outwardly from the lower edge of the back plate 338. Opposite sides 340 are secured to the top of base 339 along the opposite edges thereof. The sides 340 incline or taper outwardly as they extend upwardly in order to present a tapered configuration on each funnel for receiving the flange of piling section 211. As best shown in FIG. 21, the funnels 335 are located in vertical alignment with the marginal edges of the set piling section 210, and the distance between sides 340 is substantially equal to the size of the marginal flange structure of the section 211 that is to be interlocked with the set section.

Counterweights 342 are mounted on the side of the platform opposite the side on which the movable legs and cylinder units are located and at the transverse center of the platform. Counterweights 342 serve to balance the weight of the platform about its geometric center.

In use, alignment device 225 is handled by a crane which has its hoisting tackle secured to block 231. The device is raised above the set piling section 210 and is lowered onto the top thereof with the movable support leg 300 in its open or outer position (broken lines in FIG. 23). Once the device has been lowered onto the piling with guide bar 325 preferably powered inwardly to assist in properly guiding it onto the piling, cylinder 307 is actuated to pivot leg 300 inwardly. At the same time, the safety arm 319 is lowered to its locking position due to the extension of cylinder 322. The roller assemblies 313 of leg 300 act against walls 210*b* and 210*c* of the piling in order to assure that leg 300 is centered on the piling as shown in FIG. 24. Legs 300 and 316 bear against opposite sides of section 210 in opposition to one another to firmly support the device on top of the set piling for operation in a stationary position.

Either of the jaws can be employed to interlock section 211 with either edge of section 210. However, the interlocking of section 211 to the right edge of section 210 (as viewed in FIG. 21) will be described, it being understood that the device operates in substantially the same manner when assembling sections in the other direction from the set section. It is further important to recognize that the device acts to assemble both sections 211 and 212 while remaining in a fixed position on top of section 210.

With cylinder 272 retracted to hold the jaw plate 255 in its upper or open position (broken lines of FIG. 22), piling section 211 is raised by the crane and inserted within the jaw. Workers stationed at ground level position section 211 with its web engaged against the rollers 298 of the stationary alignment leg 295 and with its edge against the edge of the set section 210. Cylinder 272 is then extended to close the jaw and engage section 211 between the rollers of template 233 and plate 255.

Section 211 is then raised by the crane within the closed jaw and is guided by the rollers which retain its edge against the edge of section 210. Once the bottom end of section 211 has cleared the top end of section 210, the action of the roller assemblies bearing against section 211 at an angle shift it laterally in camming fashion until its edge is aligned directly above the mating edge of section 210. The three sided funnel 335 positively assures that this alignment is accurate since the marginal flange structure of section 211 is received in the funnel and is retained against the back plate 238 thereof and between the sides 240, as best shown in FIG. Section 211 is then lowered by the crane such that its margin interlocks with the mating margin of section 210.

With the device remaining in position on top of section 210, section 212 is raised by the crane and inserted in the open jaw somewhat below its top end and at an orientation 180° from that of section 211. The workers at ground level position the edge of section 212 against the edge of section 211 prior to the extension of cylinder 272 to close the jaw. Cylinder 287 is also preferably extended to close alignment leg 289 against section 211 and thus assure that same is maintained in the proper orientation with its edge positioned to become interlocked with the mating edge of section 212. This action of the alignment legs is particularly important if the top end of section 211 is below the level of platform 226 since the jaw will not be closed on section 211 in this situation. Nevertheless, section 211 is maintained in the proper orientation to become interlocked with section 212 because the closing of leg 289 serves to hold section 211 in the same position it would be in if it were engaged within the jaw. In this manner, legs 289 and 295 prevent section 211 from twisting such that its edge would be mispositioned for interlocking with the edge of section 210, which could otherwise occur when the top end of section 211 is below the level platform.

As section 212 is raised within the closed jaw, the roller assemblies guide it and maintain it in edge to edge contact with section 211. When the lower end of section 212 clears the upper end of section 211, the camming action of the various rollers and the mast 263 shifts section 212. Subsequent lowering of section 212 interlocks its margin with the margin of section 211.

The masts 253 and 263 are particularly important in situations where the upper end of section 211 is located above the level of platform 226. In this case, the lower end of section 212 will be raised above the rollers of template 233 and plate 255 before it clears the top end of section 211. However, the rollers 254 of mast 253, along with the piling shaped mast 263, will still engage section 212 and shift it laterally to the properly aligned position once it clears the top of section 211. It is thus apparent that the alignment legs 289 and 295 and the masts 253 and 263 act to assure proper threading of the piling sections even in circumstances where the top ends of the various sections are vertically staggered, as they often are. Since the ends of the piling sections are normally staggered no more than about 3 or 4 feet, the alignment legs and masts are each preferably 3 or 4 feet long, although their length is subject to variation if necessary.

The jaw mechanism of the third embodiment hingedly opens and closes about a horizontal axis and is therefore able to readily handle piling sections that are not held perfectly in plumb by the crane operator. When the piling section that is being raised is inclined from vertical, it exerts lateral forces that tend to twist the jaw. However, since the jaw is able to be opened only about a horizontal axis, such lateral forces cannot open it since it opens only under the influence of vertical forces. Accordingly, this type of jaw is advantageous in increasing the tolerance that the crane operator has in maintaining the piling sections vertically.

The third embodiment of the alignment device 225 is readily adaptable to handle any desired configuration of sheet piling. To convert the device for assembling piling other than arch web shaped sections, templates 233 and the jaw plates 255 are removed and replaced by additional templates and jaw plates that are shaped to accommodate the sheet piling that is to be assembled. The movable support leg 300 and the stationary support leg 316 are also removed and replaced by additional legs that are able to firmly support the platform on top of the piling shape that is to be assembled. This requires unpinning of the top end of leg 300 and also the removal of pins 307*a* and 319*a* to free the leg from cylinder 307 and safety arm 319.

From the foregoing it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A method of connecting a loose sheet piling section to a set sheet piling section standing in an upright position, said loose and set piling sections having mating longitudinal margins adapted to telescopically interlock, said method comprising the steps of:

positioning the loose piling section longitudinally alongside the set piling section;

positioning securely a gripping mechanism to the upper end of the set piling section;

engaging continuously and rotatively the loose piling section with said gripping mechanism at a location above the top end of the set piling section to retain the margin of the loose piling section in close proximity to the margin of the set piling section and to permit longitudinal displacement of the loose piling section.

raising longitudinally the loose piling section above the set piling section as the loose piling section is positionally maintained adjacent the upper end of the set piling section by said gripping mechanism;

shifting the loose piling section laterally to vertically align the margin thereof above the mating margin of the set piling section after the bottom end of the loose piling section has cleared the top end of the set piling section; and lowering the loose piling section to interlock the margin thereof with the margin of the set piling section.

2. A method as set forth in claim 1, wherein said shifting step comprises continuously pressing the loose piling section toward the set piling section by camming action as the loose piling section is being raised, whereby said camming action moves the loose piling section laterally in response to the bottom end of the loose piling section clearing the top end of the set piling section.

3. Apparatus for use in assembling a loose sheet piling section to a set sheet piling section standing in an upright position, said loose piling section having a longitudinal margin adapted to telescopically interlock with a mating longitudinal margin of said piling section, said apparatus comprising:

a base adapted to be positioned on top of the set piling section and supported thereon in a stationary position;

a jaw mechanism supported on said base for opening and closing movement to receive and engagingly close upon the loose piling section, said jaw mechanism including guide means for guiding the margin of the loose piling section in close proximity to the mating margin of the set piling section and for positionally maintaining the loose piling section adjacent the upper end of the set piling section as the loose piling section is longitudinally raised;

power means for opening and closing jaw mechanism; and means associated with said jaw mechanism for shifting the loose piling section laterally to vertically align said margin thereof above the mating margin of the set piling section when the bottom end of the loose piling section is raised above the top end of the set piling section.

4. Apparatus as set forth in claim 3, wherein said shifting means includes a cam member supported on said jaw mechanism and engaging the loose piling section as same is being raised, said cam member acting to press the loose piling section toward the set piling structure by camming action.

5. Apparatus as set forth in claim 3, wherein said guide means includes a roller assembly supported for rotation on said jaw mechanism and rotatively engaging the loose piling section as same is being raised.

6. Apparatus as set forth in claim 3, wherein said jaw mechanism includes a fixed jaw and a movable jaw supported for movement toward and away from said fixed jaw and thereby adapted to close upon said loose piling section, said power means being operable to move said movable jaw toward and away from said fixed jaw.

7. Apparatus as set forth in claim 6, wherein said guide means includes a pair of substantially parallel guide rollers carried on said movable jaw to rotatively engage the loose piling section, said shifting means including a cam roller carried on said movable jaw and rotatively engaging the loose piling section to press same toward the set piling section.

8. Apparatus as set forth in claim 3, wherein said jaw mechanism includes means for interchangeably receiving alternative sets of templates, said guide means including roller member carried on said templates and arranged in a different spatial pattern on each alternative set of templates, whereby the alternative sets of templates are interchangeably received on said jaw mechanism to accommodate and guide loose piling sections of diverse configurations.

9. Apparatus as set forth in claim 3, wherein said base comprises a substantially vertical beam presenting an elongate slot therein, said slot extending upwardly from the bottom end of said beam and having a size to be closely but removably inserted over the top end of the set piling section to support said base thereon in its stationary position.

10. Apparatus as set forth in claim 3, including gripping means on said base for tightly gripping the set piling section to retain said base thereon in a stationary position.

11. Apparatus as set forth in claim 3, including roller means on said base for engagement with the set piling structure to position the base thereon in a preselected position.

12. Apparatus as set forth in claim 3, wherein said base includes a pair of legs movable relative to one another to open and close upon the set piling section, said apparatus further including second power means for effecting relative movement of said legs.

13. Apparatus as set forth in claim 12, including safety locking means for locking said legs of the base in closed condition against the set piling section.

14. Apparatus as set forth in claim 3, wherein said jaw mechanism includes a fixed jaw and a movable jaw supported for pivotal opening and closing movement relative to said fixed jaw about a hinge axis oriented substantially horizontally, said power means being operable to pivotally open and close said movable jaw about said hinge axis.

15. Apparatus as set forth in claim 4, including a second jaw mechanism supported on said base for opening and closing movement to receive and engagingly close upon the loose piling section, said second jaw mechanism including guide means for guiding the loose piling section in close proximity to the set piling section as the loose piling section is longitudinally raised, and second power means for opening and closing said second jaw mechanism, the first mentioned jaw mechanism and the second jaw mechanism being spaced apart from one another in proximity to the opposite longitudinal margins of the set piling section, whereby a loose piling section can be interlocked with either longitudinal margin of the set piling section.

16. Apparatus as set forth in claim 3, including a pair of opposed, generally upright guides on said jaw mechanism extending upwardly thereabove, the respective guides being operatively located to engage the opposite sides of a loose piling section at a level above said jaw mechanism to guide and shift the loose section into marginal alignment above a piling section standing with its top end located above the level of said jaw mechanism.

17. Apparatus as set forth in claim 3, including a pair of opposed alignment legs supported at a location to extend below said jaw mechanism, the respective alignment legs being engageable against the opposite sides of a piling section standing with its top end located below the level of said jaw mechanism to maintain the standing piling section in an orientation to marginally interlock with a loose piling section raised thereabove within said jaw mechanism.

18. Apparatus as set forth in claim 17, wherein said alignment legs are supported for movement relative to one another to engage the opposite sides of the standing piling section, and including second power means for effecting relative movement of said alignment legs.

19. Apparatus as set forth in claim 3, including an elongate guide bar oriented substantially horizontally, means supporting said guide bar for movement toward and away from the set piling section, and second power means for moving said guide bar against the set piling section, said guide bar thereby assisting in the positioning of said base on said set piling section.

* * * * *